US011813507B1

(12) United States Patent
Day et al.

(10) Patent No.: US 11,813,507 B1
(45) Date of Patent: Nov. 14, 2023

(54) SYSTEMS AND METHODS FOR INSERT OF A PUTTER-TYPE GOLF CLUB

(71) Applicant: Cobra Golf Incorporated, Carlsbad, CA (US)

(72) Inventors: Cameron J. Day, Vista, CA (US); Bryson A. DeChambeau, Dallas, TX (US); Ryan L. Roach, Encinitas, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 0 days.

(21) Appl. No.: 17/370,751

(22) Filed: Jul. 8, 2021

(51) Int. Cl.
*A63B 53/04* (2015.01)

(52) U.S. Cl.
CPC ..... *A63B 53/0487* (2013.01); *A63B 53/0425* (2020.08)

(58) Field of Classification Search
CPC ..... A63B 53/0487; A63B 53/0425; A63B 53/042–049; A63B 53/0445
See application file for complete search history.

(56) References Cited

U.S. PATENT DOCUMENTS 1,968,092 A * 7/1934 Oldham ..... A63B 53/047 473/345
1,968,626 A * 7/1934 Young ..... A63B 53/047 473/329
2,429,351 A * 10/1947 Fetterolf ..... A63B 53/04 473/329
4,679,792 A * 7/1987 Straza ..... A63B 53/0487 473/331
5,542,675 A * 8/1996 Micciche ..... A63B 53/0487 473/340
5,766,093 A * 6/1998 Rohrer ..... A63B 53/0487 473/340
6,089,993 A * 7/2000 Woodward ..... A63B 53/0487 473/331
6,110,057 A * 8/2000 McKinnon ..... A63B 53/007 473/331
6,227,986 B1 * 5/2001 Fisher ..... A63B 53/0487 473/340
6,257,994 B1 * 7/2001 Antonious ..... A63B 53/0487 473/331
6,554,721 B1 * 4/2003 Woodward ..... A63B 53/0487 473/331
6,592,467 B1 * 7/2003 Gray ..... A63B 53/0487 473/340
6,699,140 B1 * 3/2004 Sun ..... A63B 53/0487 473/332
6,849,004 B2 * 2/2005 Lindsay ..... A63B 53/0487 473/331
7,500,923 B2 * 3/2009 Tateno ..... A63B 53/0487 473/340
7,794,333 B2 * 9/2010 Wallans ..... A63B 53/047 473/331

(Continued)

*Primary Examiner* — Eugene L Kim
*Assistant Examiner* — Matthew B Stanczak
(74) *Attorney, Agent, or Firm* — Quarles & Brady LLP

(57) ABSTRACT

A putter-type golf club includes a body defining a toe portion, a medial portion, a heel portion, and an insert cavity, and a face insert assembly disposed within the insert cavity. The face insert assembly includes an outer plate comprising a plurality of apertures, and an inner insert comprising a plurality of protrusions. The plurality of protrusions extend entirely through the plurality of apertures.

20 Claims, 20 Drawing Sheets

(56) References Cited

U.S. PATENT DOCUMENTS 7,824,278 B2 * 11/2010 Miyamichi ..... A63B 53/0487 473/340
8,083,611 B2 * 12/2011 Kuan ..... A63B 53/0487 473/340
8,109,841 B2 * 2/2012 Miyamichi ..... A63B 53/0487 473/340
8,292,754 B2 * 10/2012 Snyder ..... A63B 60/00 473/331
8,371,958 B2 * 2/2013 Treadwell ..... A63B 60/00 473/331
8,425,342 B2 * 4/2013 Snyder ..... A63B 60/54 473/331
8,622,850 B2 * 1/2014 Narita ..... A63B 53/0487 473/331
9,265,996 B1 * 2/2016 Abbott ..... A63B 53/007
9,555,300 B2 * 1/2017 Abbott ..... A63B 53/0466
9,566,484 B1 * 2/2017 Abbott ..... A63B 53/007
9,694,260 B1 * 7/2017 Abbott ..... A63B 60/00
9,776,051 B1 * 10/2017 Abbott ..... A63B 53/04
9,878,221 B2 * 1/2018 Abbott ..... A63B 53/007
10,905,921 B1 * 2/2021 Stubben ..... A63B 53/0487
11,161,018 B2 * 11/2021 Stubben ..... A63B 53/0429
11,161,021 B2 * 11/2021 Becktor ..... A63B 53/007
11,161,022 B2 * 11/2021 Willmott ..... A63B 53/065
11,207,572 B2 12/2021 Willmott et al.
2003/0045372 A1 * 3/2003 Vrska, Jr. ..... A63B 60/00 473/332
2005/0020378 A1 * 1/2005 Krumme ..... A63B 53/04 473/340
2007/0243949 A1 * 10/2007 Solari ..... A63B 53/08 473/340
2008/0108452 A1 * 5/2008 Chiang ..... A63B 53/0466 29/530
2010/0087269 A1 * 4/2010 Snyder ..... A63B 60/00 473/331
2010/0234127 A1 * 9/2010 Snyder ..... A63B 53/007 473/331
2010/0267466 A1 * 10/2010 Stites ..... A63B 53/04 473/282
2012/0196700 A1 * 8/2012 Rollinson ..... A63B 53/0487 473/340
2015/0375069 A1 * 12/2015 Abbott ..... A63B 53/0487 473/330
2017/0136320 A1 * 5/2017 Abbott ..... A63B 53/0487
2020/0038717 A1 * 2/2020 Stubben ..... A63B 53/0487
2021/0031078 A1 * 2/2021 Willmott ..... A63B 53/0429
2021/0113898 A1 * 4/2021 Kroloff ..... A63B 53/02
2022/0001253 A1 * 1/2022 Müller ..... A63B 53/08

* cited by examiner

SYSTEMS AND METHODS FOR INSERT OF A PUTTER-TYPE GOLF CLUB

CROSS REFERENCE TO RELATED APPLICATIONS

Not applicable.

REFERENCE REGARDING FEDERALLY SPONSORED RESEARCH OR DEVELOPMENT

Not applicable.

SEQUENCE LISTING

Not applicable.

BACKGROUND

1. Field of the Disclosure

The present disclosure relates to golf clubs, and more specifically to face insert assemblies for putter-type golf club heads.

2. Description of the Background of the Disclosure

Different types of golf clubs (e.g., irons, drivers, fairway woods, utility irons, hybrid irons/woods, putters, etc.) are used to effect different types of shots, based on a golfer's location and ball lie when playing a hole on a golf course. Each club has different overall structure, which is dependent upon the purpose of the club, but the club heads of all golf clubs comprise a face having a striking surface, which defines a striking profile that is commensurate with the underlying purpose of each respective club head. The striking surface of each club head is constructed based upon a number of factors, such as the intended contact speed with a golf ball, the desired acoustic and vibratory feedback for the golfer using the club head, and the required regulatory framework as set forth by various regulatory bodies, including the United States Golf Association ("USGA"), among other factors.

While irons, drivers, fairway woods, utility irons, and hybrid irons/woods are constructed with striking surfaces that depend upon varying considerations, the striking surfaces of putters are constructed to provide enhanced accuracy and precision at low striking speeds, so as to increase a golfer's chances of sinking a putt at any location from which a putt is an appropriate shot on a golf course. While striking surfaces of putters have an overall profile that is generally planar, golf balls are not perfectly spherical objects since they are covered in dimples, making the surface of golf balls substantially uneven. As a result, when striking the golf ball with a typical putter, the ball can bounce off at an unintended or unexpected angle. In the context of hitting a 10-foot or a 20-foot putt, if the resultant putt is off by one degree, the golfer is going to miss the hole completely. In general, golfers miss putts because of poor contact, because if the ball does not collide properly with the striking surface and align with the center of mass, the ball will very likely bounce off at an unexpected angle.

To visualize this concept, if a golf ball is dropped vertically onto a flat, horizontal surface, sometimes it will bounce vertically, but many times it will not bounce vertically, and will instead ricochet at an unexpected angle. During such an experiment, non-vertical bounces can be attributed to the uneven surface of the ball rather than any imperfections in the surface itself. A non-vertical bounce is expected, and even if the golf ball bounces within one degree of the vertical, as noted above, such an error in the context of a putt on a green can cause a significant mishit when longer putts are taken.

In addition to the end result of reducing mishits taken with a putter, other important considerations for putter striking faces include the tactile and acoustic feedback to the golfer. Successful prior art putter-type golf clubs provide a positive sensation or feel that the golf club is delivering for the golfer. Since many putter-type golf clubs include metal striking faces, a metallic feel can be associated with harsh sensation for off-center shots. While some solutions to reducing mishits have been provided, such as in U.S. Pat. Nos. 7,824,278, 8,083,611, and 9,776,051, these putter-type club heads suffer from a number of drawbacks that fail to solve the aforementioned problem in a repeatable, cost-effective, and easy to manufacture way. These prior art putter-type club heads further fail to provide a user with the tactile and auditory feedback that is desirable when using such a golf club, and can instead provide the undesirable effects of a pure metallic striking surface.

Therefore, a need exits for a striking surface of a putter that can reduce mishits, especially for longer putts, provide desirable auditory and vibratory feedback to a golfer, and be manufactured in an efficient and cost-effective manner.

SUMMARY

The present disclosure is directed to face insert assemblies for putter-type golf club heads. In some embodiments, a putter-type golf club includes a body defining a toe portion, a medial portion, a heel portion, and an insert cavity, and a face insert assembly disposed within the insert cavity. The face insert assembly includes an outer plate comprising a plurality of apertures, and an inner insert comprising a plurality of protrusions. The plurality of protrusions extend entirely through the plurality of apertures.

In some embodiments, the outer plate comprises metal, and the inner insert comprises a polymer. In some embodiments, the metal comprises steel, and the polymer comprises thermoplastic polyurethane (TPU). In some embodiments, the plurality of protrusions each define a stem and a head, and the head includes a rounded portion at a distal end thereof. In some embodiments, the plurality of apertures comprises between 10 and 1,000 apertures, and the plurality of protrusions comprises between 10 and 1,000 protrusions. In some embodiments, a diameter of each of the apertures of the plurality of apertures is between about 0.50 millimeter and about 3.0 millimeters. In some embodiments, the insert assembly further comprises an adhesive applied to a rear face of the inner insert. In some embodiments, the plurality of apertures are disposed in a hexagonal configuration. In some embodiments, the plurality of protrusions each define a stem and a head, and an outermost point of the head extends from an outer face of the outer plate by a distance of between about 0.02 millimeters and about 1.00 millimeters. In some embodiments a lower end of the insert assembly comprises a lower thickness, the upper end of the insert assembly defines an upper thickness, and the lower thickness is different than the upper thickness.

In some embodiments, a face insert assembly for a putter-type golf club includes a metal outer plate comprising a plurality of apertures, and a polymeric inner insert comprising a plurality of protrusions. The plurality of protrusions extend entirely through the plurality of apertures, the plurality of protrusions each define a stem and a head, and an outermost point of the head extends from an outer face of the outer plate by a distance of between about 0.05 millimeters and about 0.50 millimeters.

In some embodiments, the metal comprises steel, and the polymer comprises thermoplastic polyurethane (TPU). In some embodiments, the plurality of apertures are disposed in a hexagonal configuration. In some embodiments, the plurality of protrusions each define a stem and a head, and the head includes a rounded portion at a distal end thereof. In some embodiments, the plurality of apertures comprises between 100 and 1,000 apertures, and the plurality of protrusions comprises between 100 and 1,000 protrusions. In some embodiments, a diameter of each of the apertures of the plurality of apertures is between about 0.50 millimeter and about 3.00 millimeters. In some embodiments, the insert assembly further comprises an adhesive applied to a rear face of the inner insert.

In some embodiments, a method of assembling an insert assembly for a putter-type assembly includes the steps of die cutting a plurality of apertures into a metal plate, inserting the metal plate into a mold, and injection molding an inner insert having a plurality of protrusions with the metal plate such that the metal plate and the inner insert are molded together. The plurality of protrusions extend entirely through the plurality of apertures of the metal plate. In some embodiments, the plurality of protrusions each define a stem and a head, and an outermost point of the head extends from an outer face of the outer plate by a distance of between about 0.05 millimeters and about 0.50 millimeters.

DETAILED DESCRIPTION OF THE DRAWINGS

Figure 1:
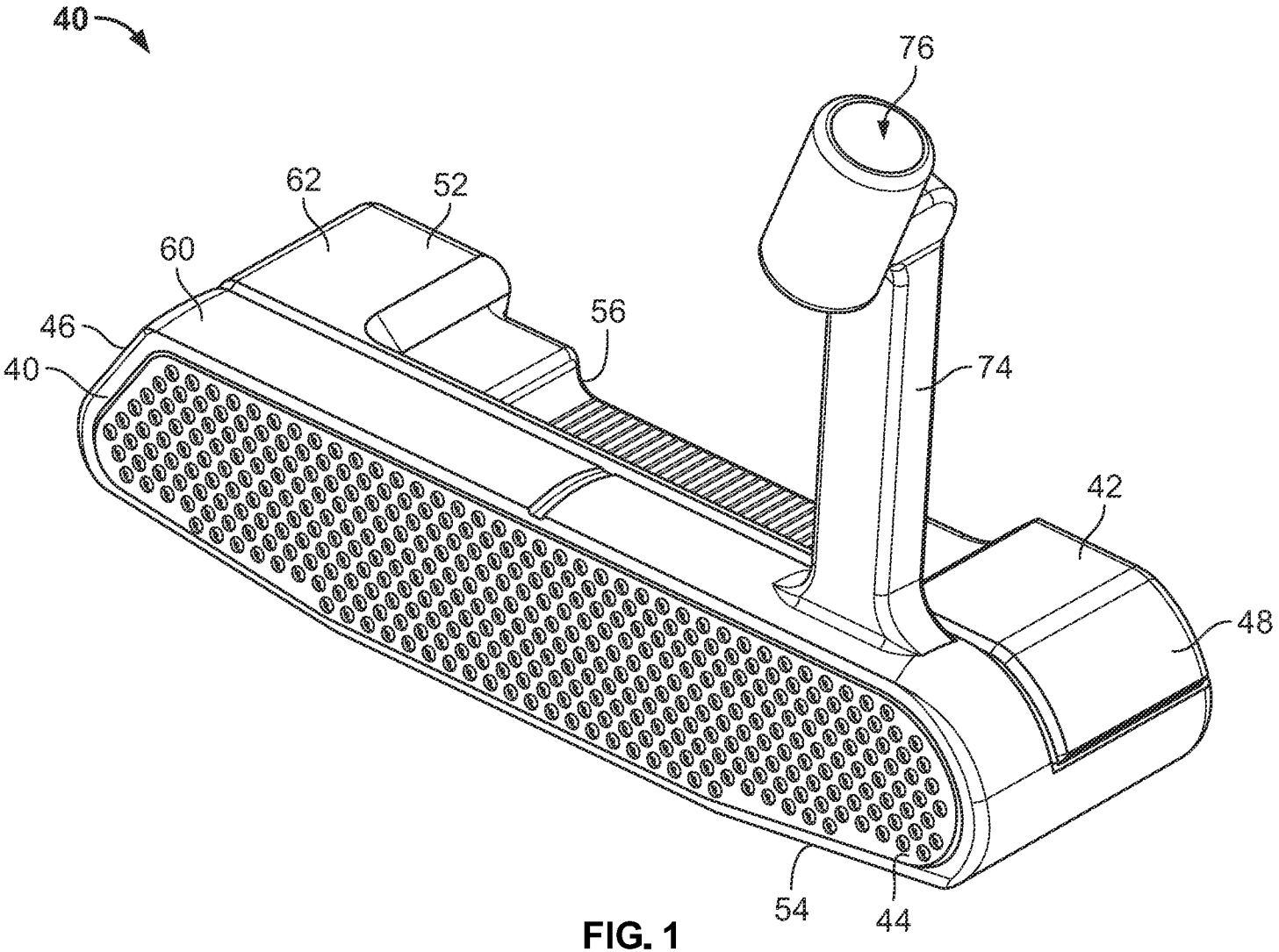
FIG. 1 is a top, front, and left side isometric view of a putter-type club head in accordance with the present disclosure.

The following discussion and accompanying figures disclose various embodiments or configurations of a golf club head having a face insert assembly that assists golfers with reducing mishits of shots taken with a putter-type golf club. The face insert assembly of the present disclosure further provides desirable acoustic and vibratory feedback to a golfer, which positively impacts a golfer's perception of hitting a golf ball with the same. As used herein, the terms "mass" and "weight" are used interchangeably, although it is understood that these terms refer to different properties in a strict physical sense. The term "about," as used herein, refers to variations in the numerical quantity that may occur, for example, through typical measuring and manufacturing procedures used for articles of manufacture that may include embodiments of the disclosure herein. Throughout the disclosure, the terms "about" and "approximately" refer to a range of values ±5% of the numeric value that the term precedes.

The present disclosure is directed to putter-type golf club heads having a face insert assembly that includes an outer plate and an inner insert, which combine to define a striking surface with a plurality of peaks in the form of hemispherical protrusions. The face insert assembly of the present disclosure overcomes issues associated with "the bad bounce problem" associated with mishits using a putter-type golf club, which is more pronounced at low putting speeds. Typically, at low putting speeds, the speed of the golf ball moving in a sideways direction is a larger fraction of the desired linear or normal speed, which typically results in a situation where the ball comes off of the putter with a larger error in the launch angle. The hemispherical protrusions of the present disclosure are provided in rows and columns to account for the non-spherical nature of golf balls, and are provided to enhance the accuracy of golf balls that are hit with the putter of the present disclosure by stabilizing the point or points of contact of the striking profile with a golf ball.

As described in detail below, the protrusions may be provided in a variety of configurations, and may take alternate forms than as shown and described hereinafter below. In general, the protrusions enhance various performance characteristics of a golf club head that includes the face insert as described herein, which may be modified to achieve a desired face flex, distance variability, launch condition, or aesthetic appearance, among other characteristics. The golf club heads disclosed herein may be manufactured using one or more of a variety of manufacturing processes or techniques. For example, the golf club heads disclosed herein may be manufactured using one or more of the manufacturing techniques disclosed in U.S. patent application Ser. No. 16/852,327, which is incorporated by reference herein in its entirety.

The face insert assembly as detailed herein is formed to counteract the non-spherical nature of golf ball geometry due to the dimples that are disposed along an outer surface of the golf ball, by including a plurality of positively-extending protrusions that protrude outward from the face, e.g., by about 0.20 millimeters (mm). The protrusions act as a multitude of singular points of contact that, during contact with a golf ball, maintain the position of the ball orientation at impact with the club head. As an example, in the context of a 10 foot putt, the hole has a radius of 5.40 cm and is 304.8 cm away from the ball before impact. From such a putting distance, and on a perfectly level surface, the ball has to be aimed within 1.0 degree of a line joining the center of the ball and a center of the hole to make the putt. To sink a 20 foot putt, the required angle drops to 0.5 degrees. The construction of the insert assembly as described herein reduces the variance beyond 1.0 degree, and provides a golfer with reduced likelihood of a mishit beyond these and other angle variances.

Referring now to FIGS. 1-6, a putter-type club head 40 is shown in accordance with the present disclosure that may be formed through an additive manufacturing process or another type of manufacturing process, e.g., casting, molding, milling, etc. The club head 40 defines a body 42 and a face insert assembly 44, which may be coupled to one another after machining of the body 42. The body 42 defines a toe side 46, a heel side 48, a front side 50, a top side or crown 52, a bottom side or sole 54, and a rear side 56. Referring to FIG. 1, the body 42 of the club head 40 is formed from metallic and/or non-metallic materials. For example, the body 42 may be formed from any one of or a combination of aluminum, bronze, brass, copper, stainless steel, carbon steel, titanium, zinc, polymeric materials, and/or any other suitable material. The body 42 includes a front portion 60 and a rear portion 62, the front portion 60 defining a face insert cavity 64 (see FIG. 6), that is configured to receive the face insert assembly 44.

Figure 2:
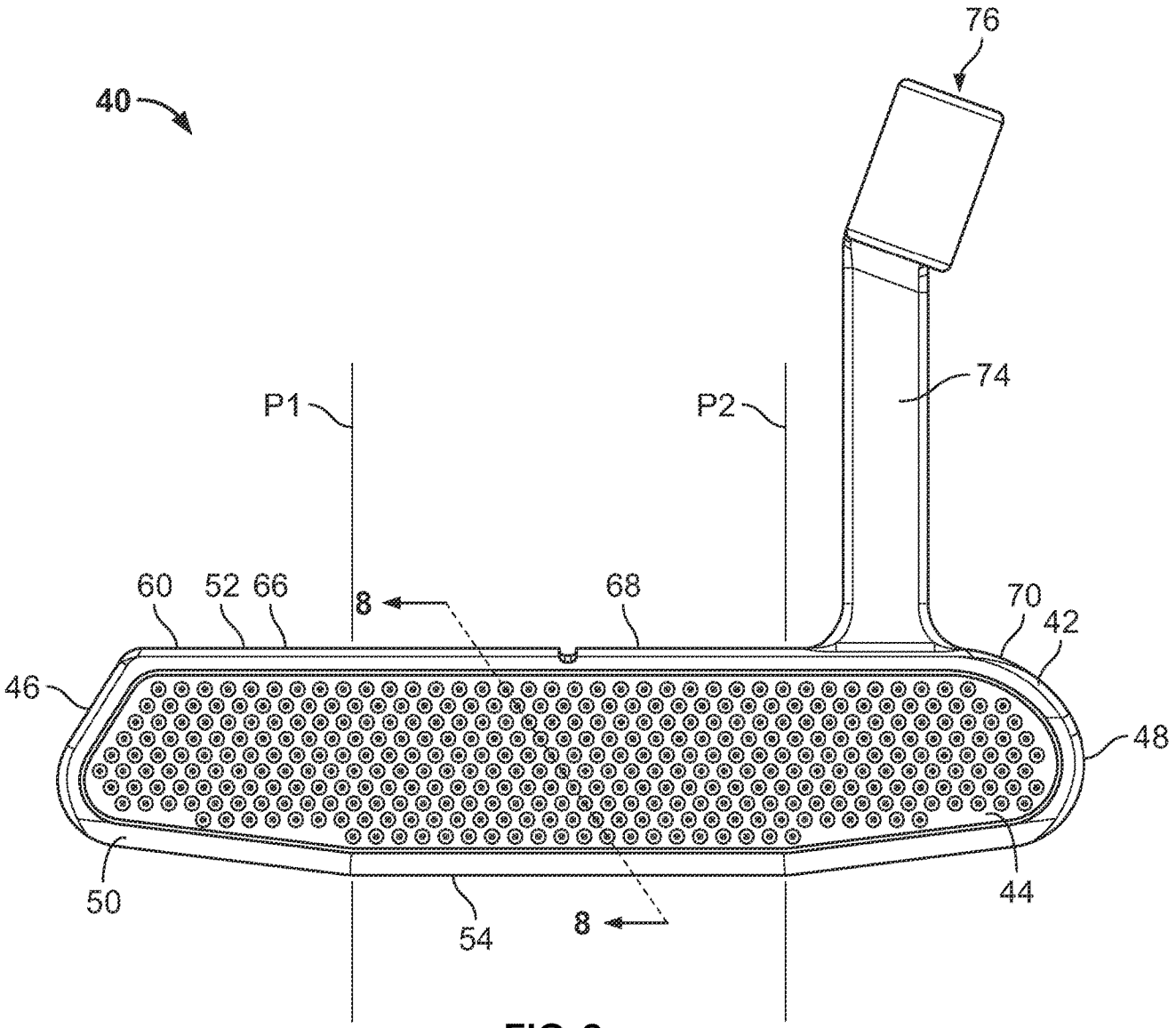
FIG. 2 is a front elevational view of the putter-type club head of FIG. 1.
Figure 3:
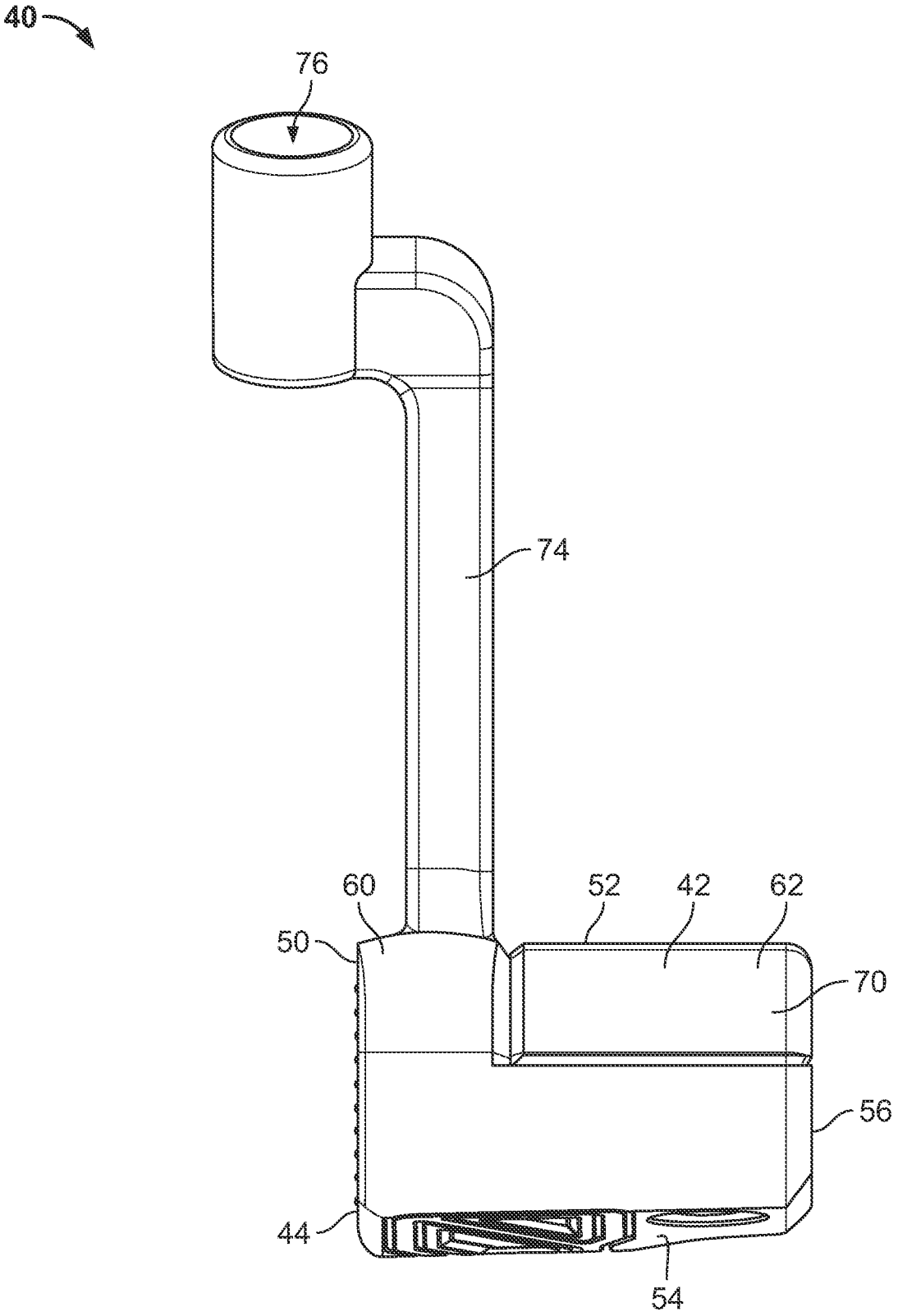
FIG. 3 is a right or heel side elevational view of the putter-type club head of FIG. 1.
Figure 4:
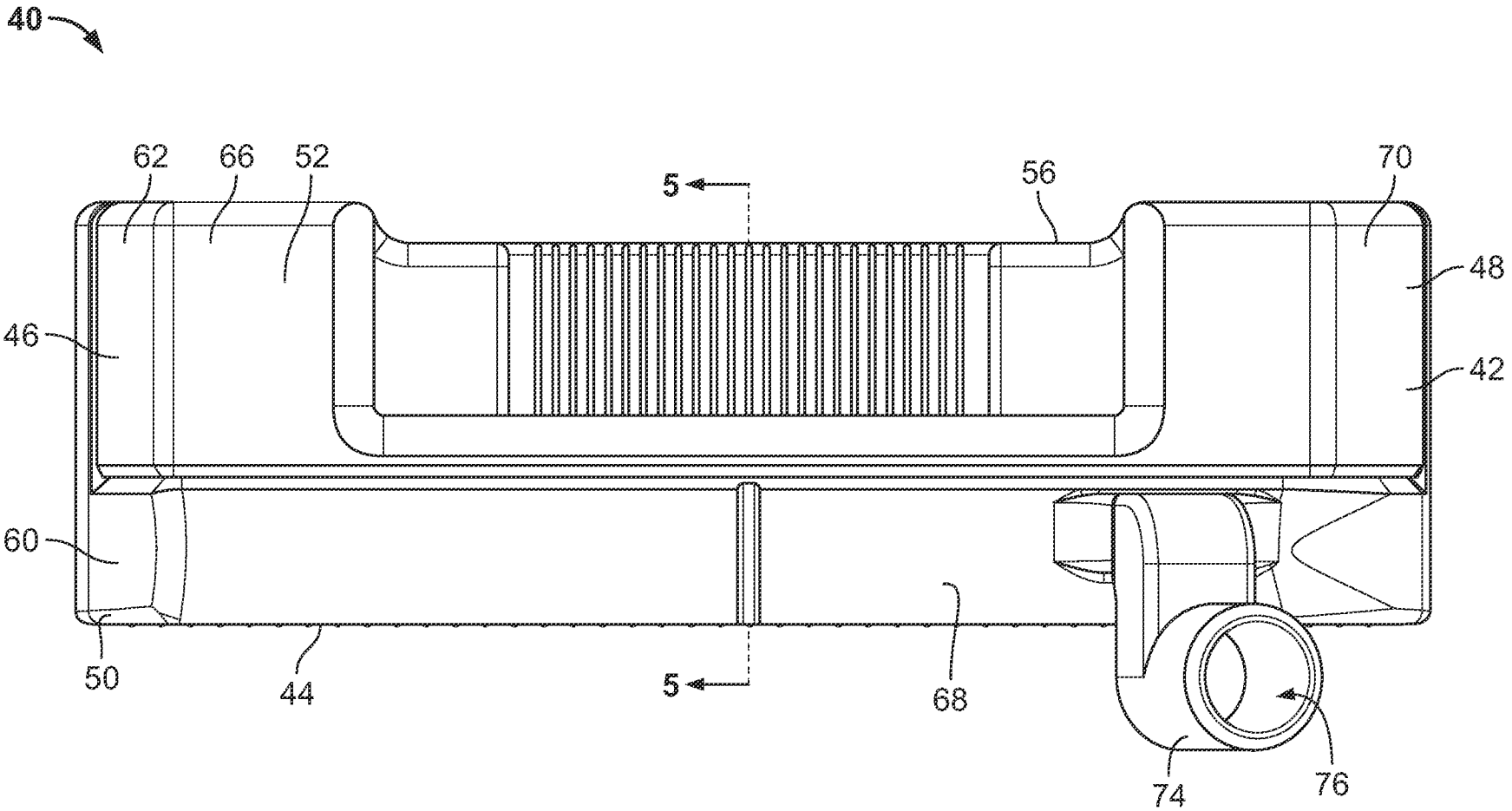
FIG. 4 is a top plan view of the putter-type club head of FIG. 1.

Referring to FIG. 2, the body 42 defines a toe portion or region 66, a medial portion or region 68, and a heel portion or region 70. The heel region 70 of the body 42 includes a hosel 74 that extends upward therefrom. In some embodiments, the heel region 70 defines an aperture (not shown) that is disposed within the heel region 70, which is configured to receive and secure a shaft (not shown) of the golf club (not shown). The toe region 66, the medial region 68, and the heel region 70 are defined by vertical lines or planes P1 and P2 that extend through the club head 40. The hosel 74 is located within the heel region 70, and extends vertically from the top side 52. In some embodiments, the hosel 74 may be at least partially disposed within the medial region 68. A shaft bore 76 extends from the hosel 74, the shaft bore 76 being sized and shaped to receive a shaft (not shown), or an element that may be coupled with the shaft. While FIGS. 3 and 4 depict various portions of the body 42 of the club head 40, it is contemplated that the face insert assembly 44 as disclosed herein may be applied to a variety of club head body types, and need not be limited to the club head 40 depicted in the figures.

Figure 5:
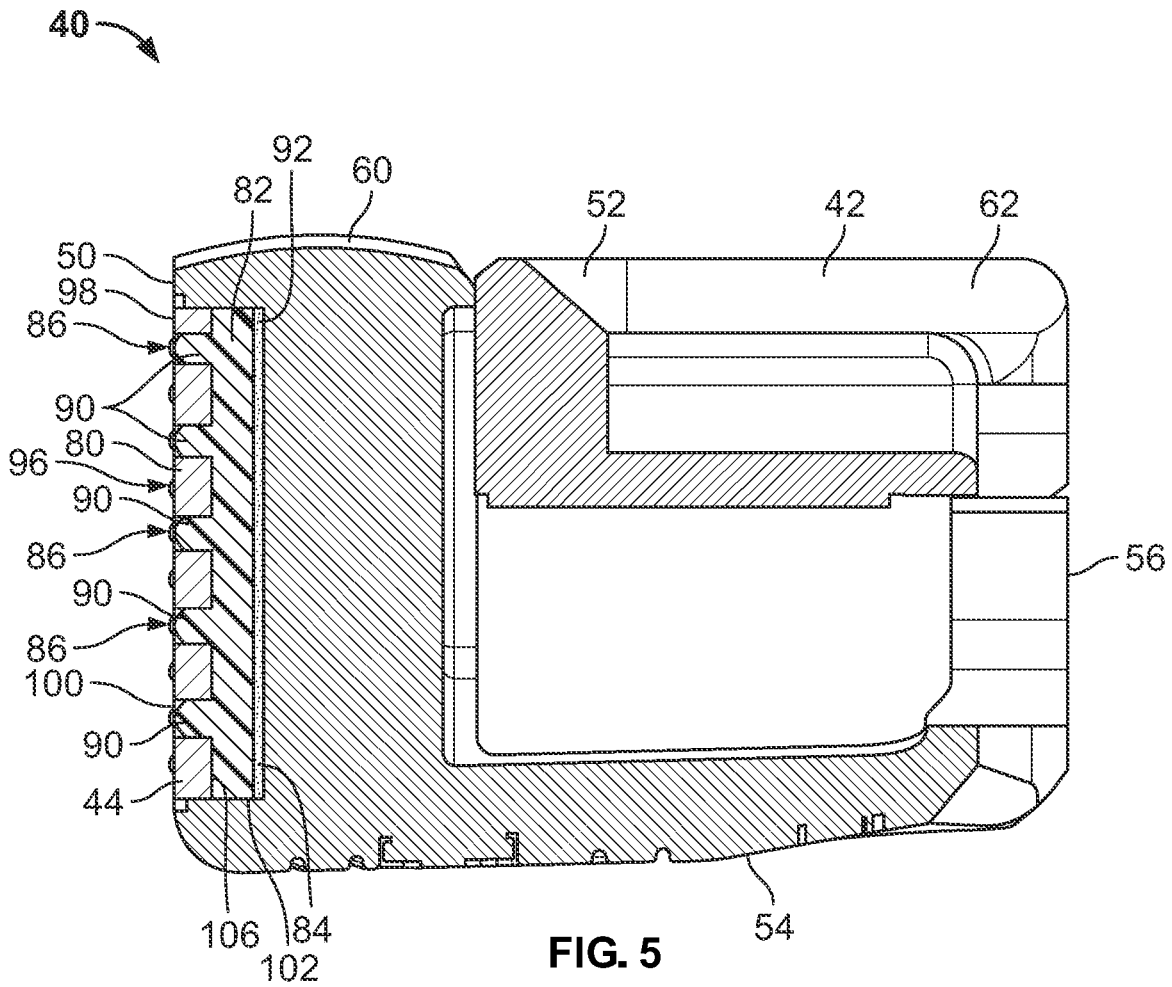
FIG. 5 is a side cross-sectional view of the putter-type club head taken through line 5-5 of FIG. 4.
Figure 6:
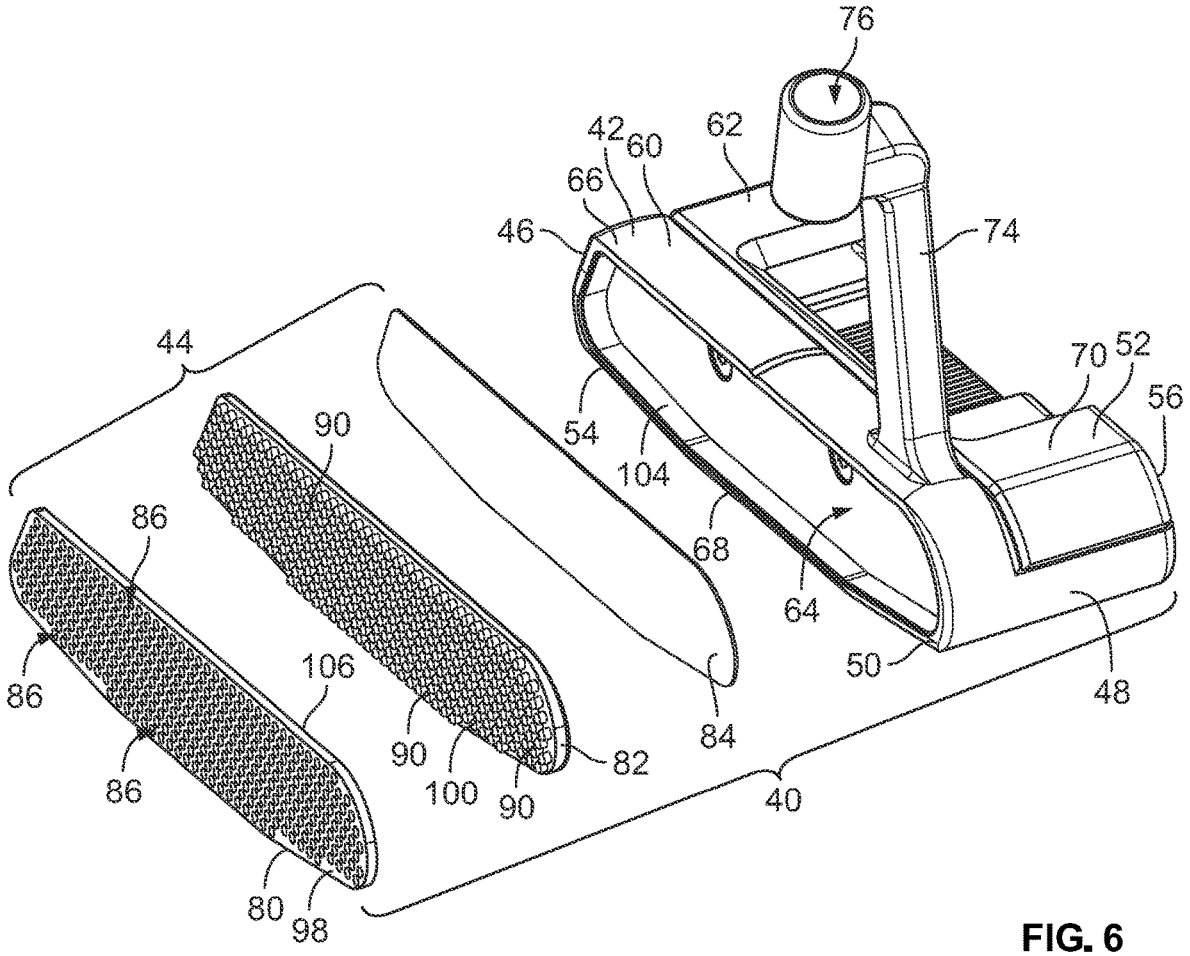
FIG. 6 is an exploded view of the putter-type club head of FIG. 1 with a face insert assembly shown in detail.

Referring to FIGS. 5 and 6, the face insert assembly 44 is shown in cross-section and an exploded view, respectively, and includes an outer plate 80, an inner insert 82, and an adhesive layer 84. The face insert assembly 44 may include more or fewer components, e.g., the adhesive layer 84 need not be included, and the face insert assembly 44 may be coupled with the body 42 in some other fashion. The outer plate 80 includes a plurality of apertures 86 that are configured in various vertical columns, horizontal rows, and inclined columns across the outer plate 80. As described hereinafter below, the outer plate 80 may comprise steel and may be manufactured via computer numerical control (CNC) machining. In some embodiments, the outer plate 80 may be die cut, or may be manufactured using another known technique of manufacturing. It is further contemplated that in some embodiments, the outer plate 80 may comprise one or more of the aforementioned materials listed above in connection with the body 42. In some embodiments, the outer plate 80 may comprise a polymeric material or non-metallic materials such as polycarbonate or ceramics, and/or may be manufactured using 3D printing.

Still referring to FIGS. 5 and 6, the inner insert 82 comprises a plurality of protrusions 90 that are disposed in the same configuration as the plurality of apertures 86 along the outer plate 80. To that end, the plurality of protrusions 90 may be disposed in an identical configuration as the apertures 86 of the outer plate 80. Unless otherwise stated, the placement of the protrusions 90 and the apertures 86 in the present disclosure are identical, and reference to locations of the same are used interchangeably. During assembly of the face insert assembly 44, the adhesive 84 (see FIG. 5), such as epoxy, is applied to a rear face 92 of the inner insert 82, and the face insert assembly 44 is thereby coupled within an insert cavity 64 of the club head 40. While the present embodiment contemplates the use of the adhesive 84 to secure the inner insert 82 within the face insert cavity 64 of the body, alternative coupling methods are contemplated to fixedly secure the face insert assembly 44 within the insert cavity 64 of the body 42.

Figure 7:
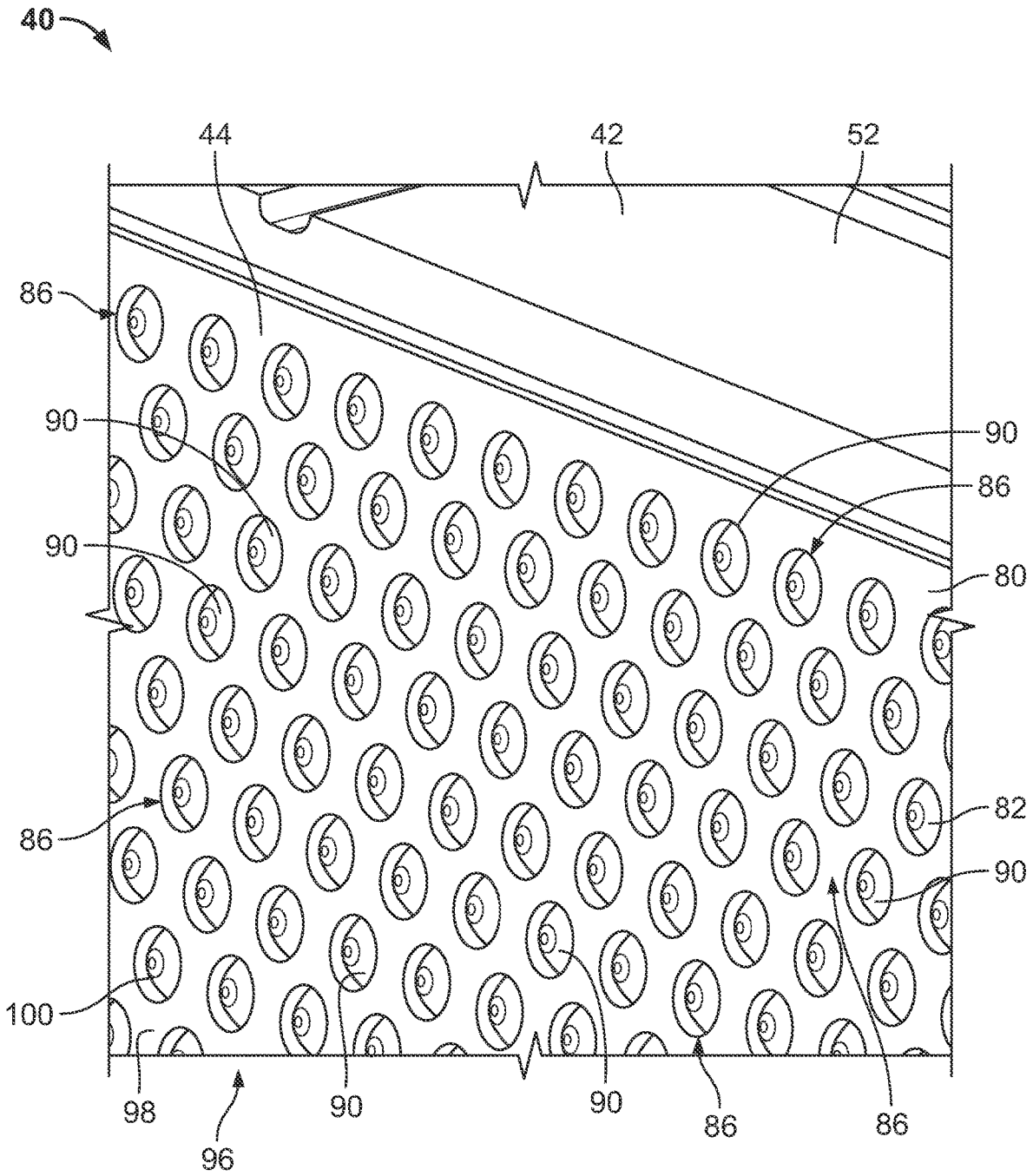
FIG. 7 is a detail view of the putter-type club head of FIG. 1 with the face insert assembly shown in detail.

Referring to FIG. 7, a striking profile 96 of the club head 40 is shown in detail, the striking profile 96 being defined by an outer surface 98 of the outer plate 80, and an outer surface 100 of the inner insert 82. More particularly, the combination of the outer surface 98 of the outer plate 80 and the outer surface 100 of the inner insert 82 that is exposed through the apertures 86 combine to define the striking profile 96. The striking profile 96 comprises an entirety of the outer surface 98 of the outer plate 80 and a portion of the outer surface 100 of the inner insert 82, and is configured for contacting a golf ball. A peripheral edge 102 (see FIG. 5) of the face insert assembly 44 aligns with an inset edge 104 of the insert cavity 64 (see FIG. 6) of the body 42. Still referring to FIG. 7, the protrusions 90 of the inner insert 82 are shown in detail, which extend proud through the apertures 86 of the outer plate 80. The protrusions 90 have a generally rounded outer profile, and each have an outermost point that is configured for contact with a ball.

Figure 8:
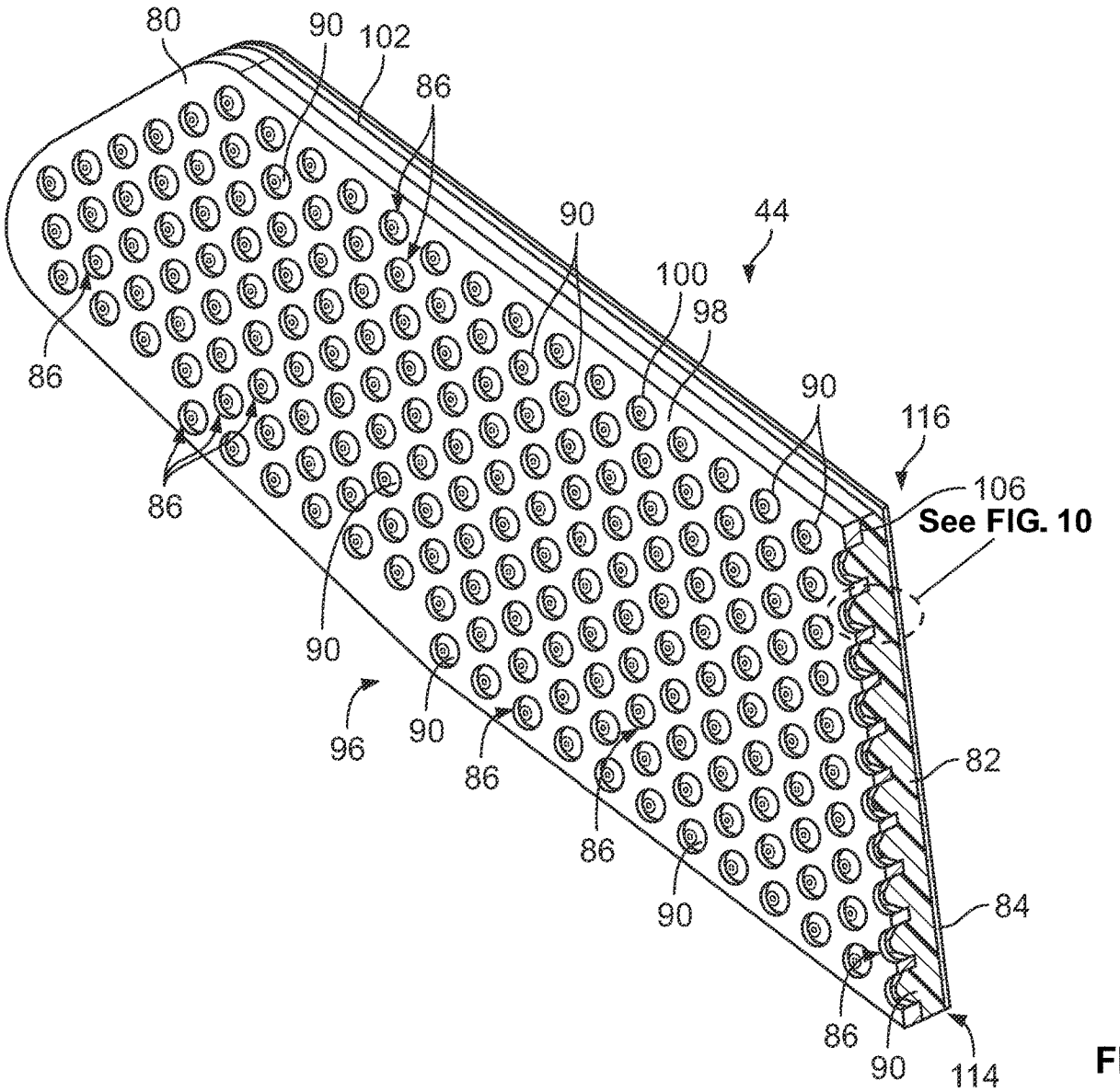
FIG. 8 is a top, front, and left side isometric, cross-sectional view of the face insert assembly of the putter-type club of FIGS. 1-7 taken through a plane that extends through line 8-8 of FIG. 2.

Referring to FIG. 8, a cross-sectional view of the face insert assembly 44 is shown, which is taken through line 8-8 of FIG. 2. The cross-section is taken along one of the inclined columns of the apertures 86. Since the protrusions 90 are disposed in linear, inclined columns, the cross-sectional view is taken through peaks of the protrusions 90. As shown through the cross-hatching of FIG. 8, the inner insert 82 comprises a polymeric material, which may include thermoplastic polyurethane (TPU). In one particular example, the inner insert 82 comprises TPU having a Shore A hardness of about 90. The shore A hardness of the material comprising the inner insert may be between about 80 and about 100, or between about 85 and about 95, or between about 88 and about 92. Other types of thermoplastic elastomers (TPE) or thermoplastic rubbers may be used, including styrenic block copolymers (TPE-s), thermoplastic polyolefinelastomers (TPO), thermoplastic vulcanizates (TPV), thermoplastic copolyester (TPC), thermoplastic polyamides (TPA), cyclic olefin resin (COR), polyacetals, or other non-classified thermoplastic elastomers.

During assembly or manufacture of the face insert assembly 44, the inner insert 82 may be molded together with the outer plate 80. In one particular embodiment, the outer plate 80 may be die cut and placed into a mold, and the inner insert 82 may be injection molded into the mold such that the inner insert 82 and the outer plate 80 are molded together. In some embodiments, a rear surface 106 of the outer plate 80 may include a plurality of teeth, depressions, or projections (not shown), which may correspond with teeth, depressions, or projections along the inner insert 82, which may be provided to enhance coupling or fusion of the outer plate 80 with the inner insert 82. In some embodiments, the inner insert 82 may include a receiving cavity (not shown) defined by an outer flange that extends from the inner insert 82, and receives the outer plate 80 therein. In alternative embodiments, other coupling features may be provided along the rear surface 106 of the outer plate 80 to enhance coupling between the outer plate 80 and the inner insert 82.

Figure 9:
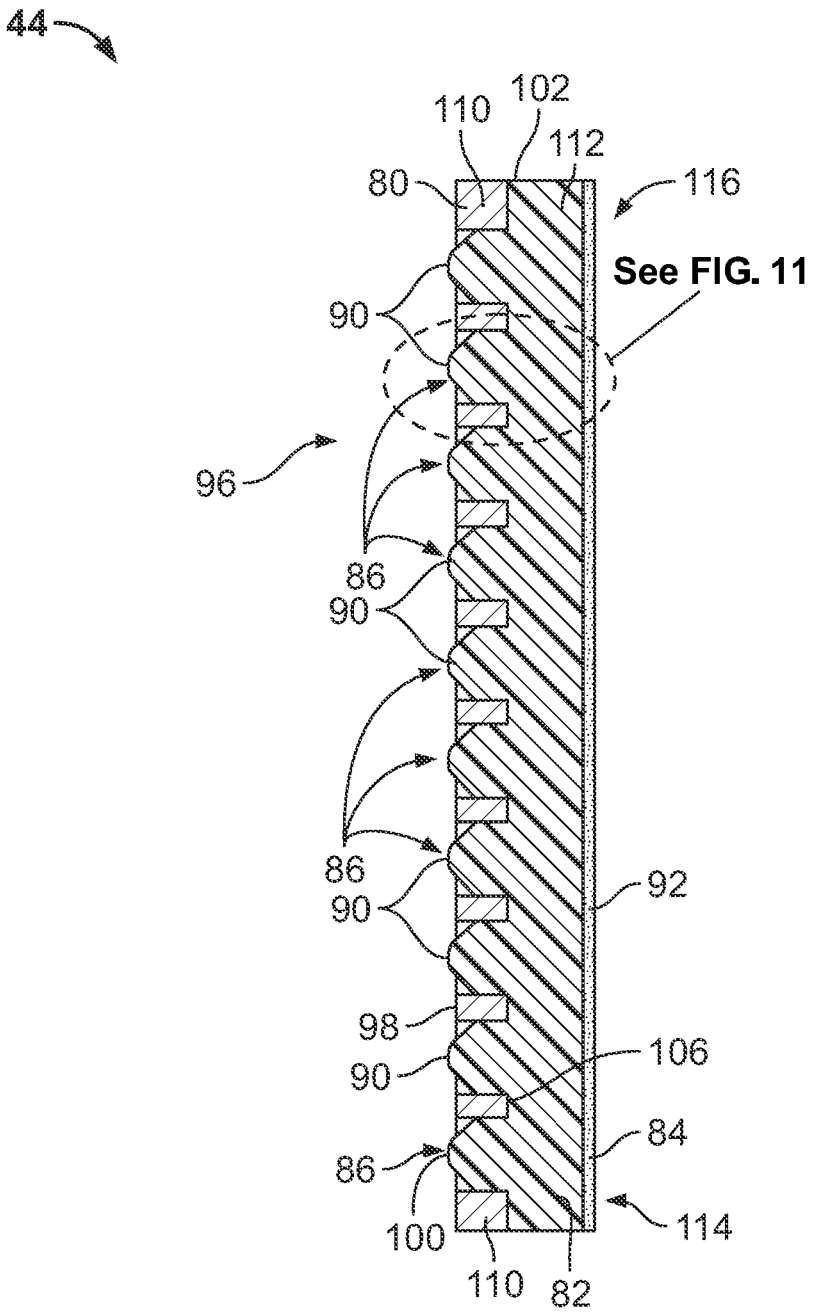
FIG. 9 is a side elevational, cross-sectional view of the face insert assembly of FIG. 8.

Referring now to FIG. 9, the cross-sectional view of FIG. 8 is shown in elevation. In particular, the outer plate 80, the inner insert 82, and the adhesive 84 are shown in detail, with the various protrusions 90 shown being disposed proud through the apertures 86 of the outer plate 80. The protrusions 90 protrude outwardly through the apertures 86 at an angle that is generally perpendicular with respect to the outer surface 98 of the outer plate 80. In that respect, the apertures 86 are generally cylindrical, such that stems 110 of the protrusions 90 are also generally cylindrical. It is contemplated that the stems 110 of at least some of the protrusions 90 may be tapered inwardly or outwardly as they extend from a base 112 of the inner insert 82.

Still referring to FIG. 9, the base 112 of the inner insert 82 is disposed entirely between the inner surface 106 of the outer plate 80 and the adhesive layer 84, and the protrusions 90 extend from the base 112 through the apertures 86 of the outer plate 80. While the base 112 is shown having a constant thickness from a lower end 114 of the insert assembly 44 to an upper end 116 thereof, it is contemplated that the base 112 may have thicker regions, which may result in different loft angles at different heights. In some embodiments, the base 112 is thicker at the lower end 114 of the insert assembly 44, and is thinner at the upper end 116 of the insert assembly 44. The outer plate 80 may also have thinner or thicker regions, which may correspond with the thicker or thinner regions of the base 112 of the insert 82. In the illustrated embodiment, the outer plate 80 is also a constant thickness from the lower end 114 of the insert assembly 44 to the upper end 116 thereof. The protrusions 90 are also generally the same height, measured from the base 112, from the lower end 114 of the face plate assembly 44 to the upper end 116 thereof, but the protrusions 90 may vary in height along one or more portions of the insert assembly 44.

Figure 10:
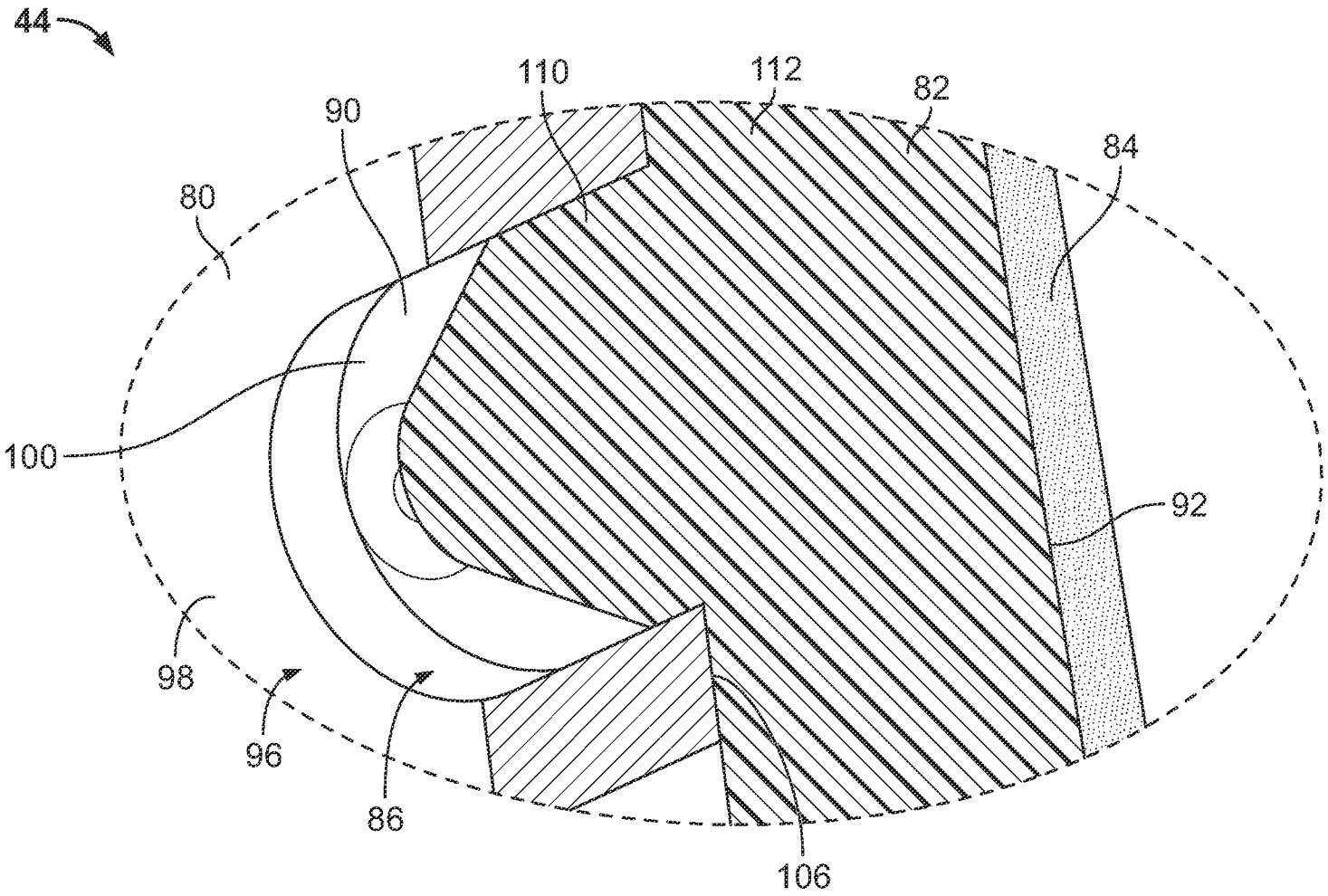
FIG. 10 is a detail view of a portion of a portion of the face insert assembly of FIG. 8.
Figure 11:
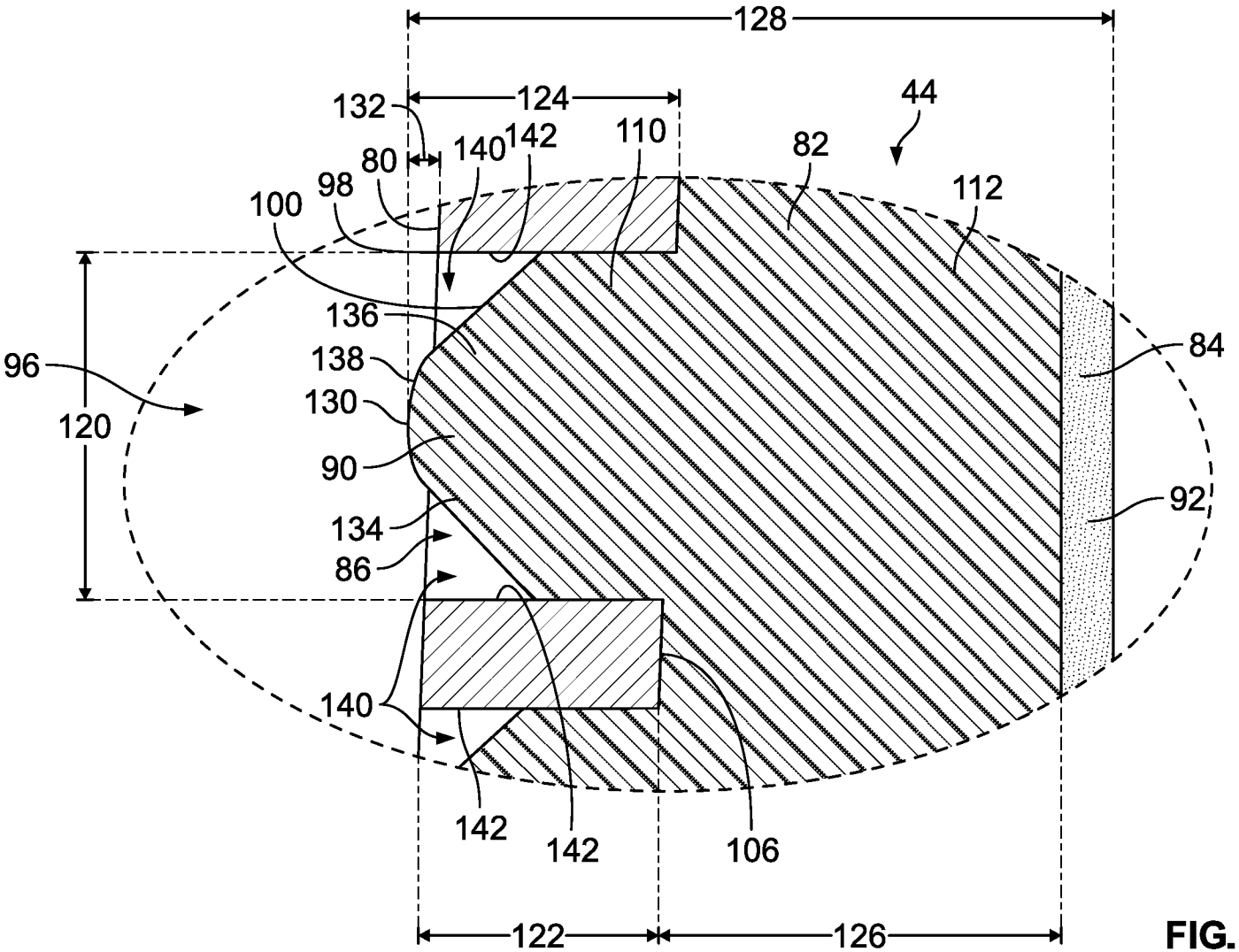
FIG. 11 is a detail view of a portion of a portion of the face insert assembly of FIG. 8.

Referring now to FIGS. 10 and 11, one of the protrusions 90 is shown extending through one of the apertures 86. Referring specifically to FIG. 11, various dimensions of the aperture 86 and protrusion 90 are shown. In particular, a diameter 120 of the aperture 86 is shown, which corresponds to a diameter of the protrusion 90. A height or thickness 122 of the outer plate 80 is also shown, along with a height or thickness 124 of the protrusion 90, a height or thickness 126 of the base 112, and a total height or thickness 128 of the inner insert 82. The thickness 124 the protrusion 90 is measured from the rear face 106 of the outer plate 80 to an outermost point 130 of the protrusion 90. In some embodiments, the thickness 124 of the protrusion 90 is between about 0.25 mm and about 3.50 mm, or between about 0.50 mm and about 3.00 mm, or between about 0.75 mm and about 2.50 mm, or between about 1.00 mm and about 2.00 mm, or between about 1.25 mm and about 1.75 mm, or about 1.5 mm. The protrusions 90 further have a proud height 132 and sit proud of the outer surface of the outer plate by about 0.20 mm. In some embodiments, the protrusions have a proud height 132 of between about 0.05 mm and about 1.00, or between about 0.10 mm and about 0.75 mm, or between about 0.15 mm and about 0.50 mm, or between about 0.17 mm and about 0.40 mm, or between about 0.19 mm and about 0.30 mm, or about 0.10 mm, or about 0.15 mm, or about 0.20 mm, or about 0.25 mm, or about 0.30 mm.

Still referring to FIG. 11, the protrusion 90 defines the stem 110, and a head 134 thereof, which includes a tapered portion 136 and a rounded portion 138. The tapered portion 136 circumscribes the head, and forms a portion of the outer surface 100 of the inner insert 82. The rounded portion 138 comprises the outermost point 130, and further forms a portion of the outer surface 100 of the inner insert 82. When viewed in elevation, the intersection of the tapered portion 136 and the rounded portion 138 is the point at which the proud height 132 of the protrusion 90 is measured, i.e., the point at which the protrusion 90 extends beyond the outer surface 98 of the outer plate 80. Air gaps 140 are formed between the tapered portion 136 of the protrusion 90 and an aperture surface 142 that defines the aperture 86. The air gaps 140 define a generally triangular profile in cross-section. During impact with a golf ball, the protrusion 90 is configured to be compressed, and portions thereof may deform into the air gaps 140. To that end, the air gaps 140 allow for the protrusions 90 to flex during contact, after which the protrusion 90 retracts to its original configuration.

Figure 12:
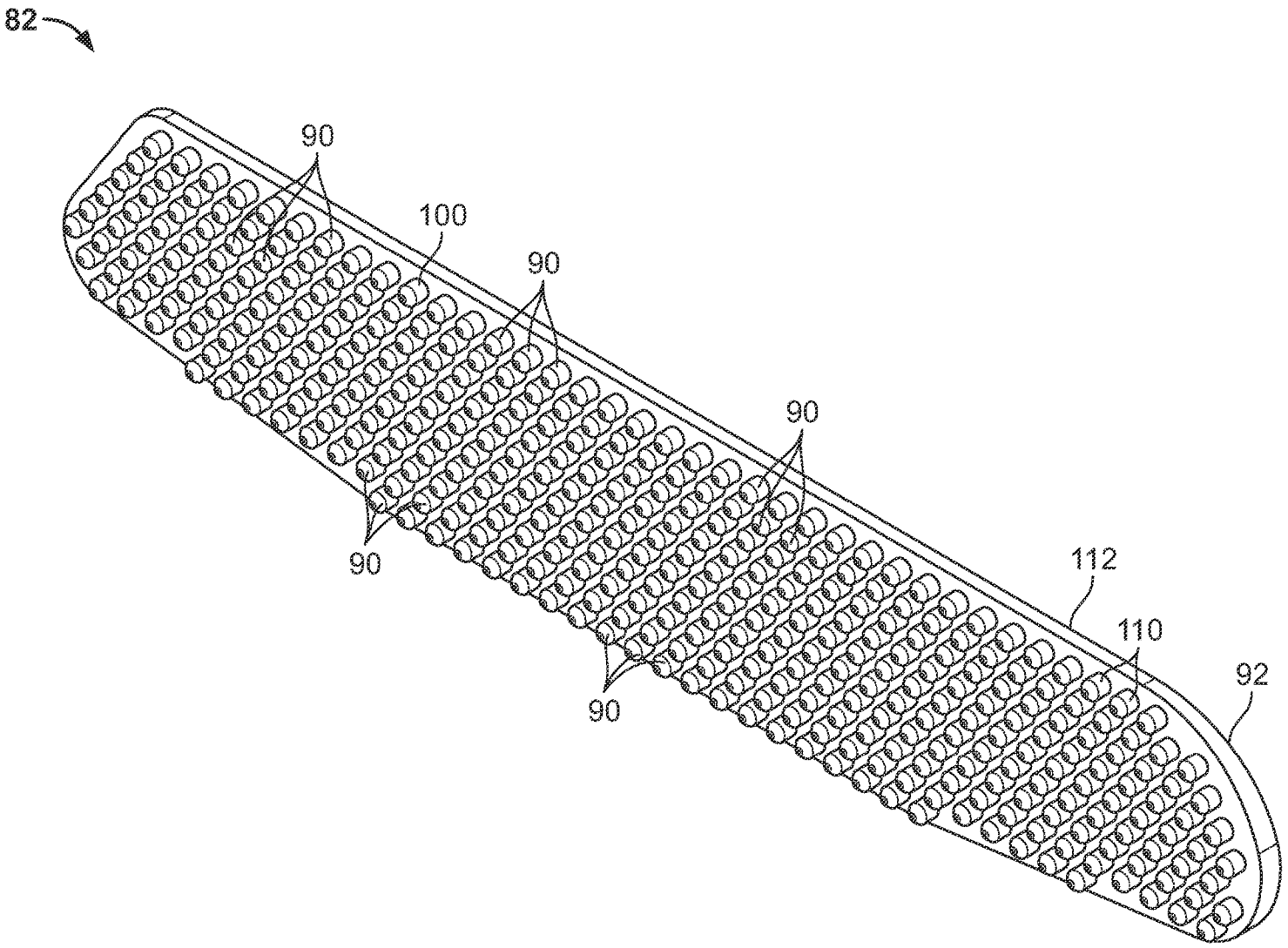
FIG. 12 is a top, front, and left side isometric view of a first component of the face insert assembly of FIG. 8.
Figure 13:
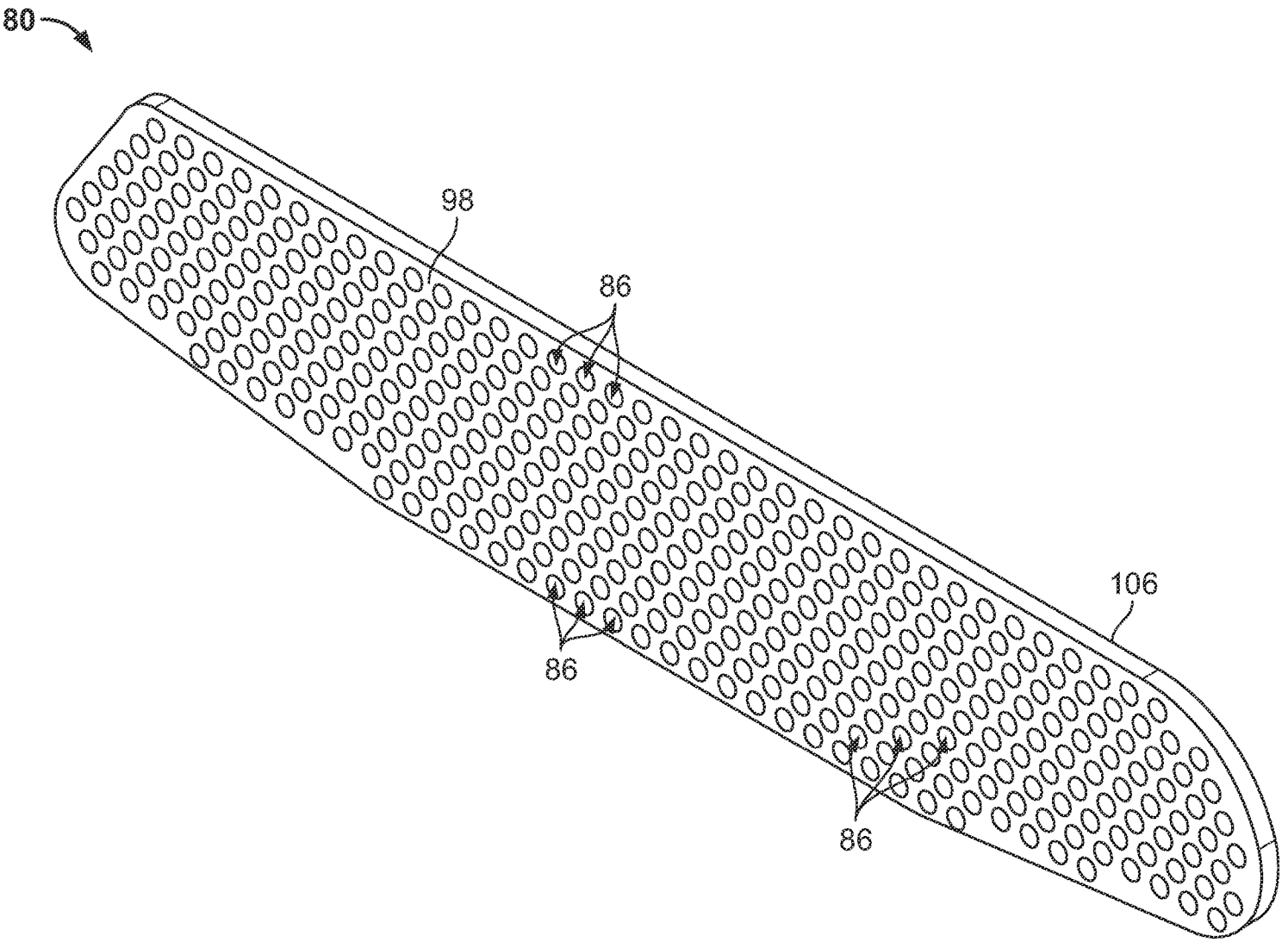
FIG. 13 is a top, front, and left side isometric view of a second component of the face insert assembly of FIG. 8.

Referring to FIGS. 12 and 13, a particular embodiment of the inner insert 82 and the outer plate 80 are shown, respectively. As noted above, the number and orientation of the protrusions 90 of the inner insert 82 and the apertures 86 of the outer plate 80 are identical. In the particular embodiment shown, the protrusions 90 and the apertures 86 define a honeycomb or hexagonal cell pattern. However, in other embodiments other patterns are contemplated. In some embodiments, there are fewer protrusions 90 than apertures 86. Still further, in the embodiment shown, there about 368 apertures 86 (and protrusions 90). However, in alternative embodiments, there may be between 10 apertures 86 and 1,000 apertures 86, or between 50 apertures 86 and 900 apertures 86, or between 100 apertures 86 and 800 apertures 86, or between 200 apertures 86 and 800 apertures 86, or between 250 apertures 86 and 700 apertures 86, or between 300 apertures 86 and 600 apertures 86, or between 325 apertures 86 and 500 apertures 86, or between 350 apertures 86 and 450 apertures 86. In some embodiments, there may be more than 100 apertures 86, or more than 150 apertures 86, or more than 200 apertures 86, or more than 250 apertures 86, or more than 300 apertures 86, or more than 350 apertures 86, or more than 400 apertures 86.

Figure 14:
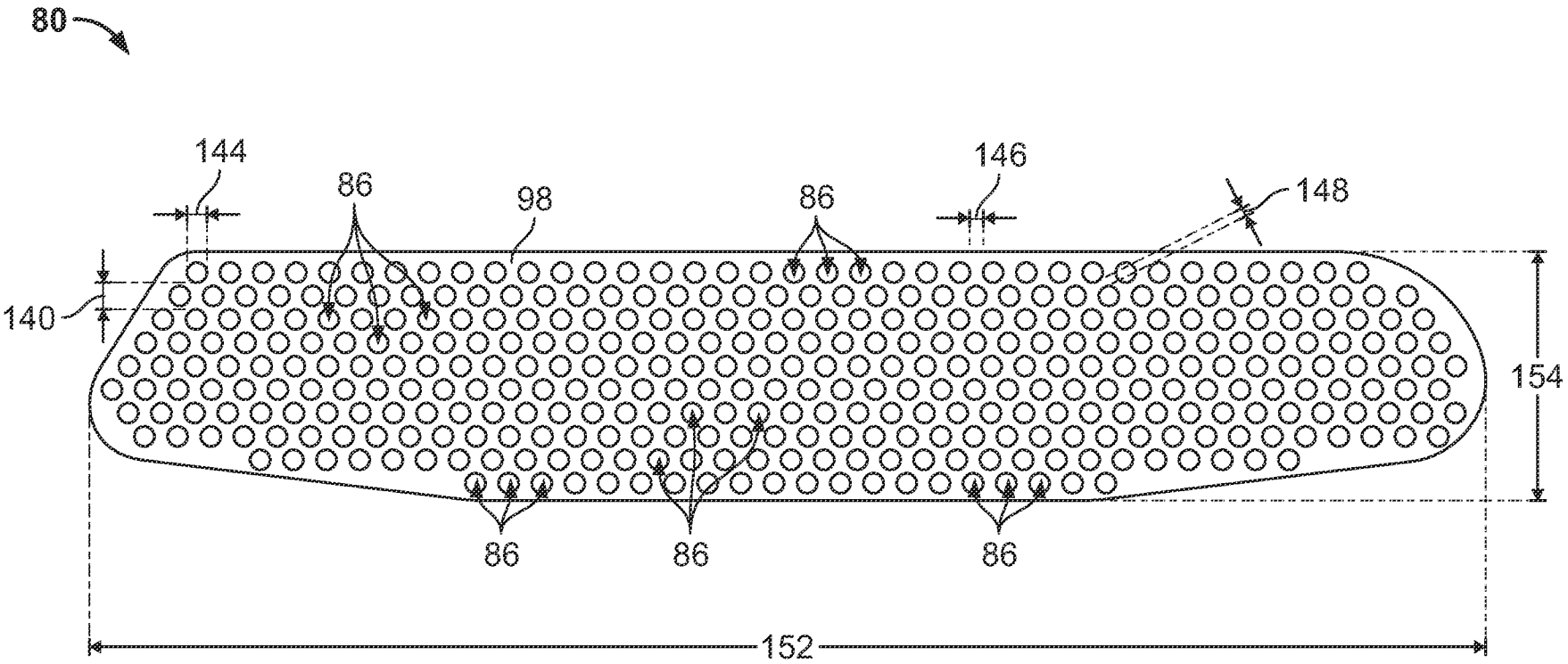
FIG. 14 is a front elevational view of the second component of FIG. 13

Referring now to FIG. 14, the outer plate 80 is shown in elevation. While the inner insert 82 is not shown from the same view in elevation, it is to be understood that the location and number of apertures 86 of the outer plate 80 as described hereinafter applies to the location and number of protrusions 90 that are disposed along the inner insert 82. Each of the apertures 86 of the plate 80 define a diameter 144, which is identical for the apertures 86 of the present embodiment. The diameter of each of the apertures 86 may be about 1.60 mm, or between about 0.50 mm and about 3.00 mm, or between about 1.25 mm and about 2.50 mm, or between about 1.50 mm and about 2.00 mm. Further, a distance between outermost points of horizontally side-by-side apertures 86 defines a horizontal gap 146, a distance between outermost points of angled side-by-side apertures 86 defines an angled gap 148, and a distance between outermost points of vertically side-by-side apertures 86 defines a vertical gap 150. In the present embodiment, the horizontal gap 146, the angled gap 148, and the vertical gap 150 between each of the apertures 86 are identical or substantially identical, respectively, i.e., the vertical, angled, and horizontal spacing between the apertures 86 is consistent between the various apertures 86. However, the vertical gap 140 is larger than the horizontal gap 146, and the horizontal gap 146 is larger than the angled gap 148. The outer plate 80 defines a plate width 152 and a plate height 154, which are taken at widest and tallest locations of the outer plate 80, respectively.

Still referring to FIG. 14, the density of the protrusions 90 protruding through the apertures 86 may be increased, and the diameters of the apertures 86 may be decreased to provide more of the protrusions 90 along the striking profile 96 of the club head 40. While the present embodiment includes between 20 apertures 86 and 41 apertures 86 disposed along each of the horizontal rows, more apertures 86 are contemplated. For example, the horizontal rows of apertures 86 may include between 20 apertures 86 and 100 apertures 86, or between 30 apertures 86 and 90 apertures 86, or between 40 apertures 86 and 80 apertures 86, or between 50 apertures 86 and 70 apertures 86, or more than 20 apertures 86, or more than 30 apertures 86, or more than 40 apertures 86, or more than 50 apertures 86, or more than 60 apertures 86, or more than 70 apertures 86, or more than 80 apertures 86, or more than 90 apertures 86.

Further, while the present embodiment includes between 1 aperture 86 and 5 apertures 86 disposed along each of the vertical columns, more apertures 86 are contemplated. For example, the vertical columns of apertures 86 may include between 1 aperture 86 and 10 apertures 86, or between 2 apertures 86 and 9 apertures 86, or between 3 apertures 86 and 8 apertures 86, or between 4 apertures 86 and 7 apertures 86, or more than 2 apertures 86, or more than 3 apertures 86, or more than 4 apertures 86, or more than 5 apertures 86, or more than 6 apertures 86, or more than 7 apertures 86, or more than 8 apertures 86, or more than 9 apertures 86.

Still further, while the present embodiment includes between 3 apertures 86 and 10 apertures 86 disposed along each of the inclined columns, more apertures 86 are contemplated. For example, the inclined columns of apertures 86 may include between 3 apertures 86 and 20 apertures 86, or between 5 apertures 86 and 18 apertures 86, or between 7 apertures 86 and 16 apertures 86, or between 9 apertures 86 and 14 apertures 86, or between 10 apertures 86 and 12 apertures 86, or more than 5 apertures 86, or more than 7 apertures 86, or more than 9 apertures 86, or more than 11 apertures 86, or more than 13 apertures 86, or more than 15 apertures 86, or more than 17 apertures 86, or more than 19 apertures 86.

Still referring to FIG. 14, the diameter 144 of the apertures 86 may be identical across all of the apertures 86, or the diameter 144 may vary from left to right, right to left, up to down, or down to up. For example, the diameter 144 of the apertures 86 within the uppermost horizontal row may be larger or smaller than the diameter 144 of the apertures 86 within of one or more of the rows below the uppermost horizontal row. Similarly, the diameter 144 of the apertures 86 within the left-most vertical column may be larger or smaller than the diameter 144 of the apertures 86 within the right-most vertical column. Even further, the diameter 144 of the apertures 86 may increase and then decrease, or vice versa, when moving from the uppermost horizontal row in a downward direction, the lowermost horizontal row in an upward direction, the left-most vertical column in a rightward direction, or the right-most vertical column in a leftward direction.

Figure 15:
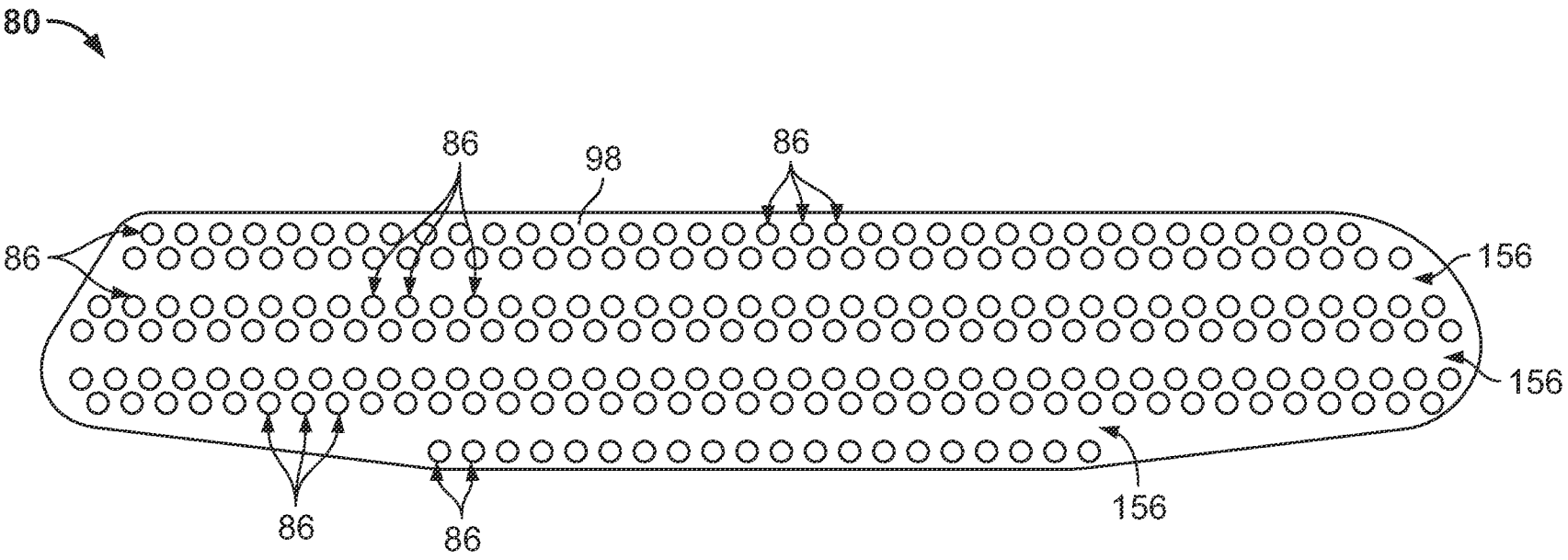
FIG. 15 is a front elevational view of another embodiment of the second component of FIG. 13.

Referring now to FIG. 15, an alternative embodiment of the outer plate 80 is shown, which includes horizontal gaps 156 of material between horizontal rows of the apertures 86. In the illustrated embodiment, there are three of the horizontal gaps 156 between horizontal rows of the apertures 86. It is further contemplated that in some embodiments, vertical gaps (not shown) may be provided between vertical columns of the apertures 86. The horizontal gaps 156 may define alternative angles of attack, i.e., the gaps may provide for the use of Descending Loft Technology™, which may comprise two, three, four, or five different angled surfaces, i.e., one, two, three, four, or five degrees of loft. As such, different horizontal rows of the apertures 86 may be lofted at different angles, i.e., a first portion of the plate 80 corresponding to a first row of the apertures 86 may be angled at a first angle, a second portion of the plate 80 corresponding to a second row of the apertures 86 may be angled at a second angle, different than the first angle, a third portion of the plate 80 corresponding to a third row of the apertures 86 may be angled at a third angle, different than the first and second angles, etc. However, in the present embodiment, the outer surface 98 of the outer plate 80 defines a generally planar surface.

Figure 16:
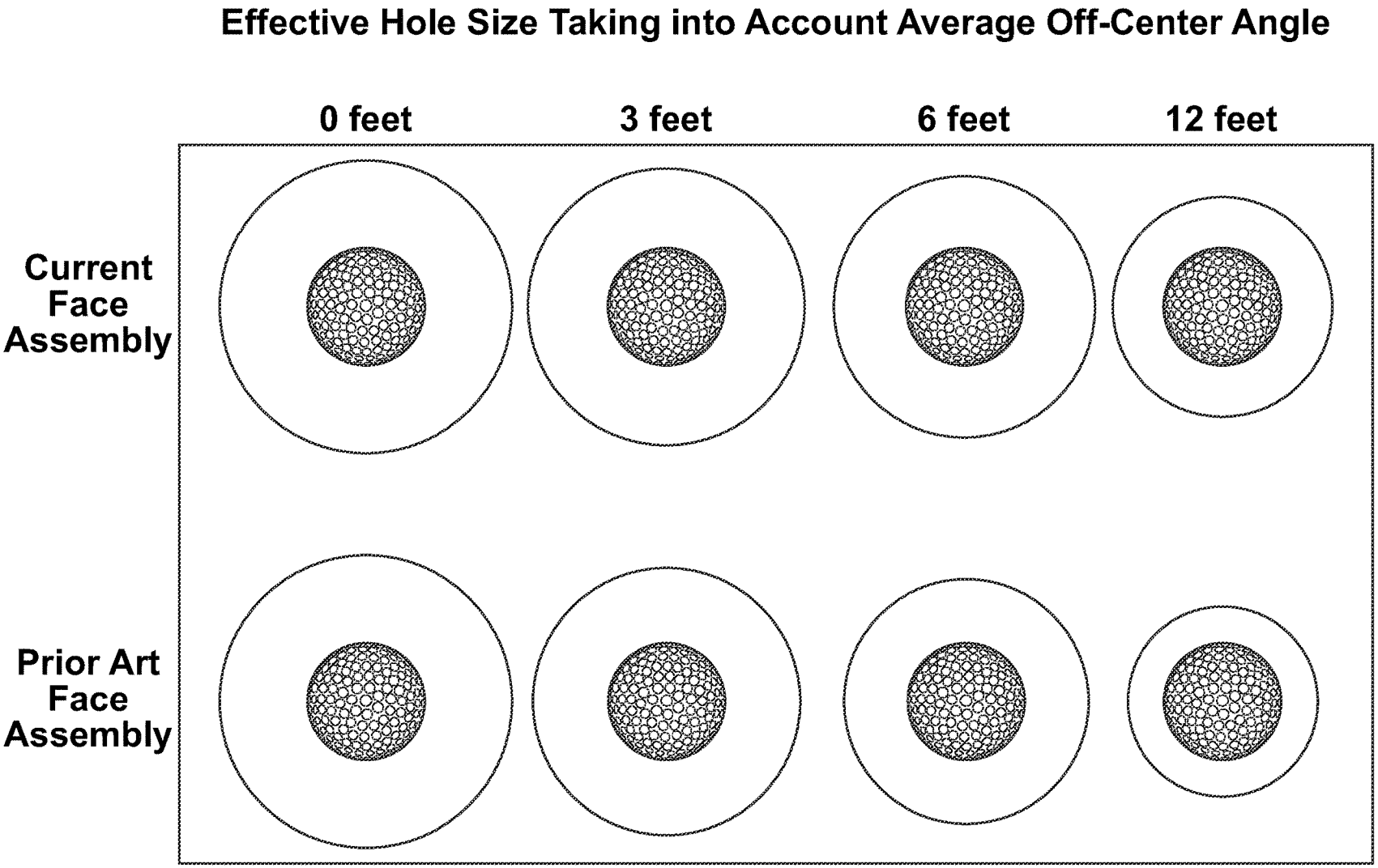
FIG. 16 is a schematic image of an effective size of a hole on a green of a golf course taking into account the average off-center angle using the face insert assembly of FIGS. 8-14 and a prior art face assembly.

Referring now to FIG. 16, a schematic visualization is shown highlighting the effective hole size of a hole on a green for a putt taken from 0 feet, 3 feet, 6 feet, and 12 feet, with a putter having the face insert assembly 44 of the present disclosure and a club having a prior art face insert assembly. As described herein, a putt taken from 0 feet is a putt taken from immediately adjacent an edge of the hole, and is used to provide a baseline for the data. As a result, the hole size for a 0 foot putt is 100% of the hole size since any forward movement of the ball will place the ball into the hole. The visualization has been generated based upon data that was obtained during testing, and is shown in the tables below.

During testing, 20 putts were taken with each of the different face insert assemblies using the same putter and a robotic arm to hit the balls approximately 3 feet at the same velocity each time. For each of the putts, the offline distance was measured at 13.6 inches, and the data was extrapolated to determine the horizontal distance that the ball would be off-center at 3 feet, 6 feet, and 12 feet. For the measurements of the putts taken at 3 feet, the offline distance, i.e., distance off-center, from the target was measured, and the data was extrapolated for the remaining distances. A perfectly flat green was assumed for the data, such that the putt would remain along a linear path in order to arrive at the offline amount at the putt distances shown. The putts used during testing were controlled to use the same striking speed for both the prior art face insert assembly and the face insert assembly 44. As noted above, for each putt, the average distance off-center was measured or extrapolated in inches, and is compiled into the table below.

Referring to Tables 1 and 2 below, the average distance off-center is provided in the first row of each Table. The second row includes the average distance off-center as a percentage of a standard golf hole diameter, which has a radius of 5.40 cm (2.13 in.) and a diameter of 10.80 cm (4.25 in). The third row includes the maximum measured distance off-center, and the fourth row includes the maximum distance off-center as a percentage of the golf hole diameter. Table 1 illustrates the foregoing data and comparisons for the prior art insert assembly that was tested, while Table 2 illustrates the foregoing data and comparisons for the insert assembly 44 as disclosed herein.

TABLE 1

| Prior Art Insert Assembly | 0 feet | 3 feet | 6 feet | 12 feet |
|---|---|---|---|---|
| Average Inches Off-Center | 0.14 in. | 0.37 in. | 0.74 in. | 1.47 in. |
| Percentage of Golf Hole Diameter | 3% | 6% | 17% | 35% |
| Maximum Inches Off-Center | 0.29 in. | 0.75 in. | 1.49 in. | 2.99 in. |
| Percentage of Golf Hole Diameter | 7% | 18% | 35% | 70% |

TABLE 2

| Insert Assembly of Present Disclosure | 0 feet | 3 feet | 6 feet | 12 feet |
|---|---|---|---|---|
| Average Inches Off-Center | 0.10 in. | 0.26 in. | 0.53 in. | 1.06 in. |
| % of Golf Hole Width | 2% | 6% | 12% | 25% |
| Maximum Inches Off-Center | 0.24 in. | 0.62 in. | 1.25 in. | 2.49 in. |
| % of Golf Hole Width | 6% | 15% | 29% | 59% |

When further analyzing the data acquired through the testing of Tables 1 and 2, it is readily apparent that as the hole is farther away for a particular shot, the differences between the average distance off-center increases between the prior art insert assembly and the insert assembly 44 of the present disclosure. That is, as the distance between the initial position of the ball and the hole increases, the prior art insert assembly performs poorer than the insert assembly 44 of the present disclosure, having a larger average distance off-center. Table 3 is provided below to further illustrate the differences in both magnitude and percentage between the insert assemblies.

TABLE 3

| Comparison of Data from Tables 1 and 2 | 0 feet | 3 feet | 6 feet | 12 feet |
|---|---|---|---|---|
| Average Inches that Prior Art Insert is More Off-Center | 0.04 in. | 0.10 in. | 0.21 in. | 0.42 in. |
| Percentage of Golf Hole Diameter | 1% | 2% | 5% | 10% |

Figure 17:
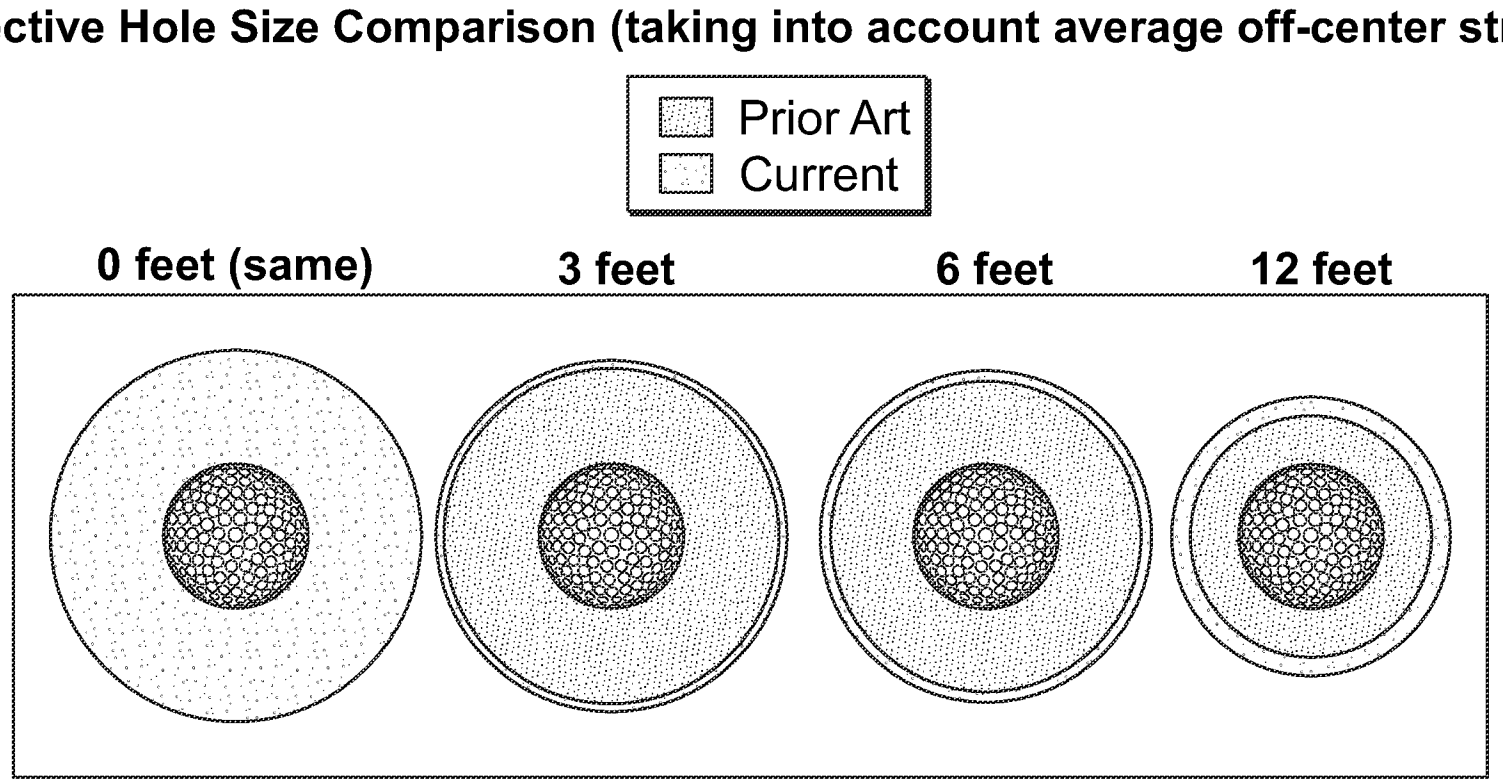
FIG. 17 is an overlay of the effective hole sizes of FIG. 16 overlaid to illustrate that the effective hole size using the face insert assembly of FIGS. 8-14 is larger than the effective hole size using the prior art face insert assembly.

As noted above, and still referring to FIG. 16, the data from the tables above is illustrated schematically, taking into account the average off-center angle that was determined based on the testing of the prior art insert assembly and the insert assembly 44 of the present disclosure. FIG. 17 illustrates an overlay of the schematic of FIG. 16 to highlight the difference between the effective hole sizes, which demonstrates that as the putting distance increases, the effective hole size for the insert assembly 44 remains larger than the effective hole size for the prior art insert assembly. The effective hole size is a visualization of what the hole size equates to due to an average of the absolute value of the offline angles of the 20 putts taken with each insert assembly. Due to the offline potential of each insert, the margin for error in other aspects of a putt that impact direction become smaller. In the case of the testing noted above, the insert assembly 44 of the present disclosure produced less of an average offline amount and thus, the visualization shows the hole as bigger relative to the prior art insert assembly.

Figure 18:
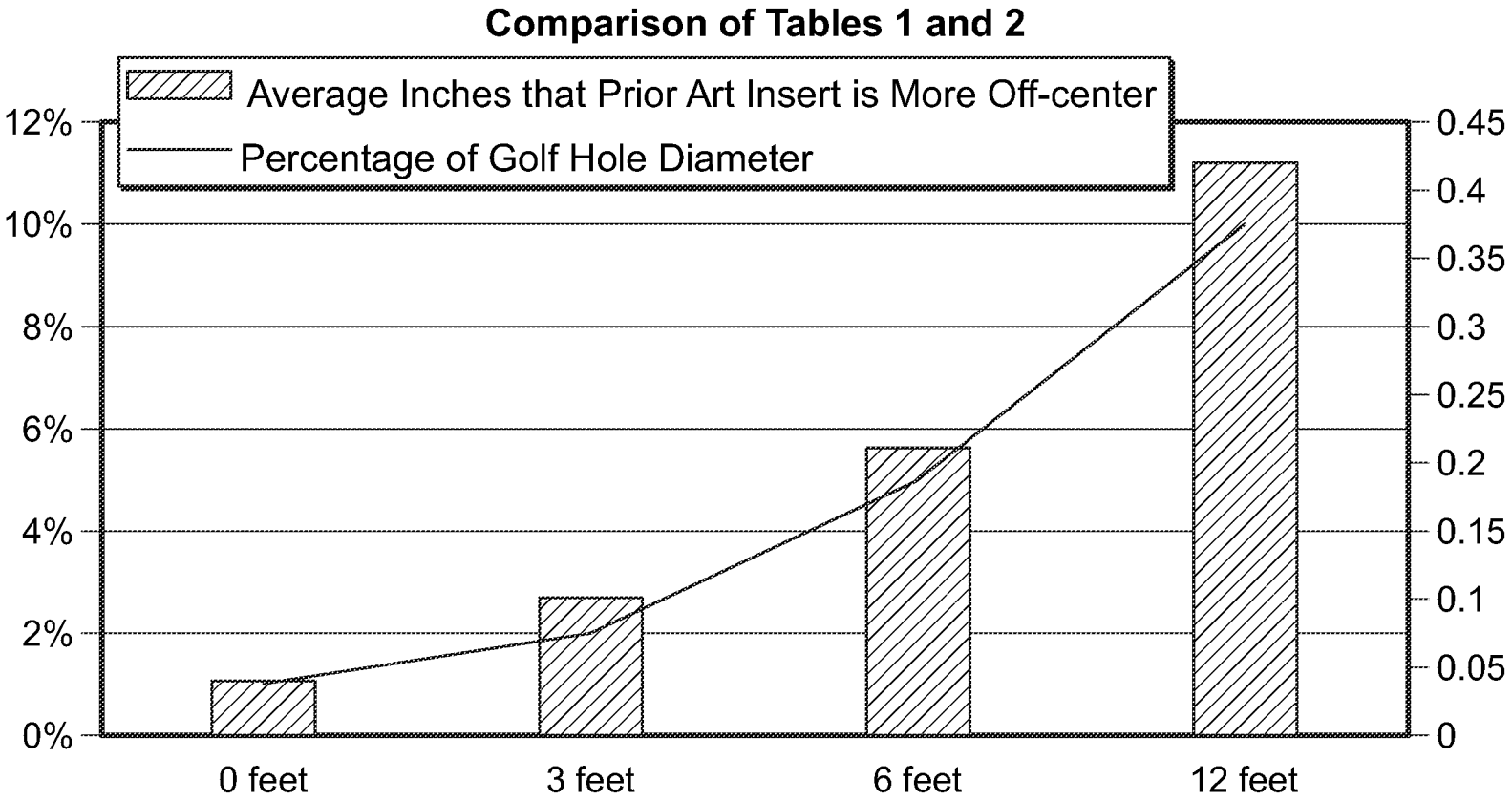
FIG. 18 is a graph illustrating the results of testing that illustrates a comparison of the average distance of prior art insert assembly with the face insert assembly of FIGS. 8-14.

To that end, and as shown in the graph of FIG. 18, which illustrates the data of Table 3 graphically, as the distance of the putt increases, the average off-center distance of a golf ball hit with the prior art insert increases substantially. While the prior art insert assembly resulted in an average distance off-center that was only about 0.10 inches (or 2% of a golf hole diameter), at a distance of 12 feet the distance off-center spiked to 0.42 inches (or 10% of a golf hole diameter). While the magnitudes of the distances may be perceived as small, these differences can result in a golfer making 10% fewer putts from a distance of 12 feet, which can result in one or more additional shots or strokes during a round of golf.

Figure 19:
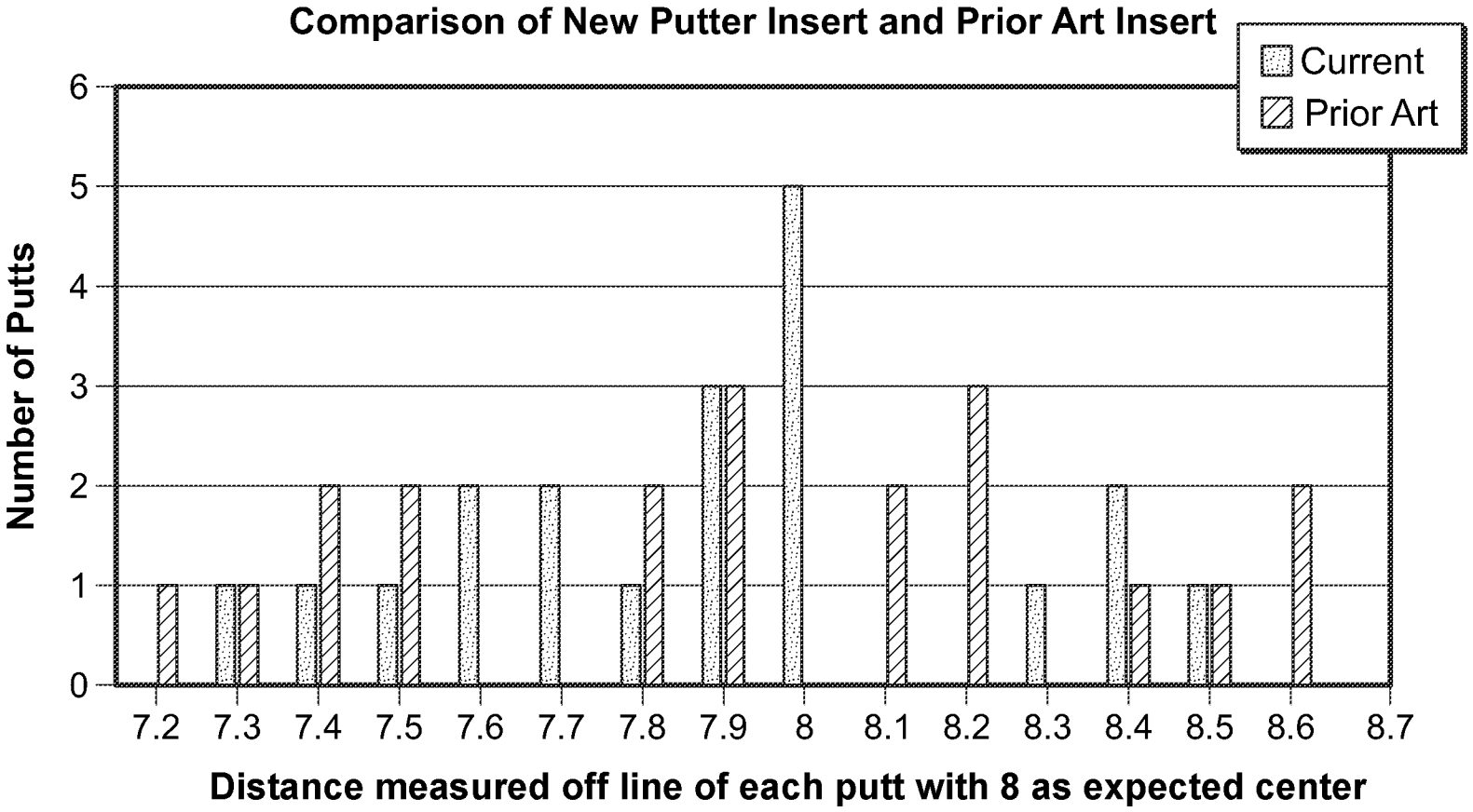
FIG. 19 is a graph illustrating the results of a frequency of putts measured at various horizontally offline locations taken with the face insert assembly of FIGS. 8-14 and the prior art face insert assembly.

While the above data, schematics, and graph highlight the differences in accuracy between the insert assembly 44 of the present disclosure and the prior art insert assembly at different putting distances, Table 4 below and the graph of FIG. 19 highlight the increased accuracy of the insert assembly 44 of the present disclosure when compared with the prior art insert assembly when reducing or eliminating other factors that may impact the trajectory of the ball, such as the putting surface. Table 4 includes data from testing that included the prior art insert assembly used for testing above, and the insert assembly 44 of the present disclosure. For testing, the clubs comprising each of the prior art insert assembly and the insert assembly 44 were swung in identical conditions at the same speed to achieve identical striking conditions. The frequency distribution of the measured putts was then analyzed, and the results are provided in Table 4.

Figure 20:
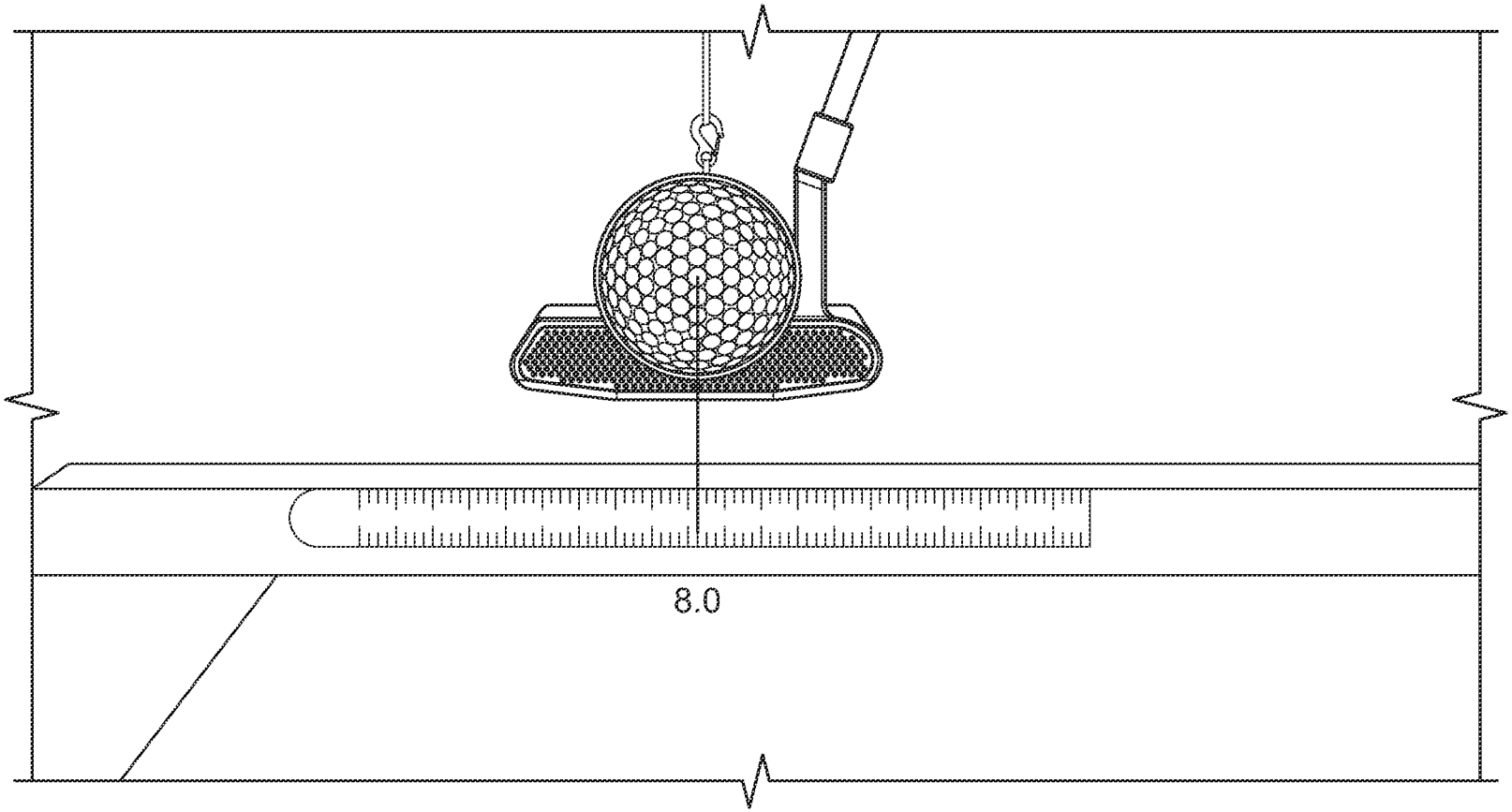
FIG. 20 is an illustration of the experimental setup used to capture the frequency data of FIG. 19, which depicts a golf ball coupled with a string, and a putter configured to strike the ball in an expected direction aligning with a center of a ruler at an 8 cm mark.

FIG. 20 illustrates the testing environment that was used to acquire the data of Table 4, which included a golf ball suspended with a string, and a horizontally-disposed ruler. Since the ball was suspended in the air, the ground surface was eliminated as a potential factor to disrupt the trajectory of the ball. The ball and string were centered along the ruler at the 8.00 cm mark, and a camera was used to take a picture of the ball as it passed over the ruler, after being struck by the putter. A vertical measurement was taken from a center of the ball to determine the horizontal distance offline of each ball, for each of the prior art insert assembly and the insert assembly 44. As provided in the first row of Table 4, the measured average of the 20 shots of the prior art insert assembly was determined to cross over the ruler at 7.93 cm, while the average of the 20 shots taken with the insert assembly 44 was 7.90 cm, a difference of only 0.03 cm. As noted above, the ball and the string were centered along the ruler at the 8.00 cm mark; thus, each of the distributions averaged within 0.10 cm of the target of 8.00 cm.

TABLE 4

| Distribution Statistics | Prior Art Insert Assembly | Current Insert Assembly |
|---|---|---|
| Average | 7.93 cm | 7.90 cm |
| Standard Deviation | 0.44 cm | 0.33 cm |
| Maximum | 8.60 cm | 8.50 cm |
| Minimum | 7.20 cm | 7.30 cm |
| Range | 1.40 cm | 1.20 cm |

Importantly, all of the data derived from the testing of the prior art assembly and the insert assembly 44 of the present disclosure favored the insert assembly 44. The data collected from the testing is shown graphically in FIG. 19. While the averages of the prior art insert assembly (7.93 cm) and the insert assembly 44 (7.90 cm) are helpful to highlight the overall consistency of the shots taken during testing since the difference amounts to approximately a 0.38% difference, the variance in the standard deviations of the prior art insert assembly (0.44 cm) and that of the insert assembly 44 (0.33 cm) is substantial at approximately a 25% difference. Still further, the difference between the maximum offline distance of the prior art assembly (8.60 cm) and that of the insert assembly 44 (8.50 cm), and between the minimum offline distance of the prior art assembly (7.20 cm) and that of the insert assembly 44 (7.30 cm) each weight in favor of the insert assembly 44 providing for more accuracy.

Still referring to Table 4, the data is further buttressed by the ranges of the prior art insert assembly (1.40 cm) and the insert assembly 44 (1.20 cm) being separated by about 14.3%. As noted above with respect to the effective size of the hole for the different insert assemblies, such a percentage difference between the overall accuracy can be substantially impactful for a golfer, and can result in several strokes being added or subtracted to a score, solely because of differences between the striking profile of the putter face.

Any of the embodiments described herein may be modified to include any of the structures or methodologies disclosed in connection with different embodiments. Further, the present disclosure is not limited to club heads of the type specifically shown. Still further, aspects of the club heads of any of the embodiments disclosed herein may be modified to work with a variety of golf clubs.

As noted previously, it will be appreciated by those skilled in the art that while the disclosure has been described above in connection with particular embodiments and examples, the disclosure is not necessarily so limited, and that numerous other embodiments, examples, uses, modifications and departures from the embodiments, examples and uses are intended to be encompassed by the claims attached hereto. Various features and advantages of the invention are set forth in the following claims.

INDUSTRIAL APPLICABILITY

Numerous modifications to the present disclosure will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

We claim:

1. A golf club, comprising:

a body defining a toe portion, a medial portion, a heel portion, and an insert cavity; and a face insert assembly disposed within the insert cavity, the face insert assembly comprising:

an outer plate having a planar outer surface, an inner surface, and comprising a plurality of cylindrical apertures; and an inner insert comprising a plurality of protrusions, wherein each of the protrusions of the plurality of protrusions extends entirely through each of the respective cylindrical apertures of the plurality of apertures, wherein each of the protrusions comprises a cylindrical stem and a head having a tapered portion that extends from the cylindrical stem and a rounded portion that extends from the tapered portion and defines an outermost point, wherein each of the cylindrical apertures is defined by a cylindrical aperture surface, wherein air gaps are provided between each head of the plurality of protrusions and each respective cylindrical aperture surface of the plurality of apertures, wherein each of the air gaps define a triangular cross-sectional profile along a plane that extends through the outermost point of the head, and wherein each of the air gaps extends around the entire head of each protrusion and is disposed only between the cylindrical aperture surface and the tapered portion of the head.

2. The golf club of claim 1, wherein the outer plate comprises metal, and the inner insert comprises a polymer.

3. The golf club of claim 2, wherein the metal comprises steel, and the polymer comprises thermoplastic polyurethane (TPU).

4. The golf club of claim 1, wherein the head includes a semi-spherical portion at a distal end thereof.

5. The golf club of claim 1, wherein the plurality of apertures comprises between 100 and 1,000 apertures, and wherein the plurality of protrusions comprises between 10 and 1,000 protrusions.

6. The golf club of claim 1, wherein a diameter of each of the apertures of the plurality of apertures is between about 0.50 millimeter and about 3.00 millimeters.

7. The golf club of claim 1, wherein the insert assembly further comprises an adhesive applied to a rear face of the inner insert.

8. The golf club of claim 1, wherein the plurality of apertures are disposed in a hexagonal configuration.

9. The golf club of claim 1, wherein an outermost point of the head extends from an outer face of the outer plate by a distance of between about 0.05 millimeters and about 0.50 millimeters.

10. The golf club of claim 1, wherein each of the protrusions is configured to be compressed such that portions thereof deform into each respective air gap.

11. The golf club of claim 1, wherein the plurality of apertures are disposed in horizontal rows with at least one horizontal gap therebetween.

12. The golf club of claim 1, wherein each of the apertures defines a diameter, which is identical for each of the apertures of the plurality of apertures.

13. A face insert assembly for a golf club, comprising:

a metal outer plate having a planar outer surface, an inner surface, and comprising a plurality of cylindrical apertures; and a polymeric inner insert comprising a plurality of protrusions, wherein each of the protrusions of the plurality of protrusions extends entirely through each of the apertures of the plurality of apertures, wherein each of the protrusions of the plurality of protrusions defines a cylindrical stem and a head having a tapered portion that extends from the cylindrical stem and a rounded portion that extends from the tapered portion and defines an outermost point, wherein the outermost point of the head extends from an outer face of the outer plate by a distance of between about 0.05 millimeters and about 0.50 millimeters, wherein each of the cylindrical apertures is defined by a cylindrical aperture surface, wherein air gaps are provided between each head of the plurality of protrusions and each respective cylindrical aperture surface of the plurality of apertures, wherein each of the air gaps define a triangular cross-sectional profile along a plane that extends through the outermost point of the head, and wherein each of the air gaps extends around the entire head of each protrusion and is disposed only between the cylindrical aperture surface and the tapered portion of the head.

14. The face insert assembly of claim 13, wherein the metal comprises steel, and the polymer comprises thermoplastic polyurethane (TPU).

15. The face insert assembly of claim 13, wherein the plurality of apertures are disposed in a hexagonal configuration.

16. The face insert assembly of claim 13, wherein the head includes a semi-spherical portion at a distal end thereof.

17. The face insert assembly of claim 13, wherein the plurality of apertures comprises between 100 and 1,000 apertures, and wherein the plurality of protrusions comprises between 10 and 1,000 protrusions.

18. The face insert assembly of claim 13, wherein a diameter of each of the apertures of the plurality of apertures is between about 0.50 millimeter and about 3.00 millimeters.

19. The face insert assembly of claim 13, wherein the insert assembly further comprises an adhesive applied to a rear face of the inner insert.

20. The face insert assembly of claim 13, wherein each of the apertures defines a diameter, which is identical for each of the apertures of the plurality of apertures.

* * * * *